US008360160B2

(12) United States Patent
Giroux et al.

(10) Patent No.: US 8,360,160 B2
(45) Date of Patent: Jan. 29, 2013

(54) DEEP WATER DRILLING WITH CASING

(75) Inventors: Richard L. Giroux, Cypress, TX (US); Doug Reid, Canning Vale (AU); Albert C. Odell, II, Kingwood, TX (US); Gregory G. Galloway, Conroe, TX (US); Mark J. Murray, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 13/104,748

(22) Filed: May 10, 2011

(65) Prior Publication Data

US 2012/0006567 A1 Jan. 12, 2012

Related U.S. Application Data

(60) Continuation of application No. 11/363,817, filed on Feb. 28, 2006, now Pat. No. 7,938,201, which is a continuation-in-part of application No. 11/140,858, (Continued)

(51) Int. Cl.
*E21B 19/18* (2006.01)

(52) U.S. Cl. ..... 166/380; 166/382; 175/171

(58) Field of Classification Search ..... 175/57, 175/320, 171, 402; 166/380, 207, 382
See application file for complete search history.

(56) References Cited

U.S. PATENT DOCUMENTS 5,148,875 A * 9/1992 Karlsson et al. ..... 175/62
5,168,942 A * 12/1992 Wydrinski ..... 175/50

(Continued)

*Primary Examiner* — Daniel P Stephenson
(74) *Attorney, Agent, or Firm* — Patterson & Sheridan, LLP

(57) ABSTRACT

Methods and apparatus are provided to place a conductor pipe and a casing in a subsea environment. In one embodiment, a conductor pipe is jetted or drilled into the subsea floor. Thereafter, a casing drilling assembly comprising a drill casing and a drilling assembly is connected to the drill pipe using a crossover. The drilling assembly urged into the seafloor until a casing latch on the drilling assembly is engaged with a casing profile of the conductor pipe. During drilling, instrumentation in the drilling assembly may be used to measure geophysical data. The measured data may be used to optimize the drilling process. After the drill casing is engaged with the conductor pipe, cementing may be performed to set the drill casing.

10 Claims, 17 Drawing Sheets

Related U.S. Application Data filed on May 31, 2005, now Pat. No. 7,083,005, which is a continuation of application No. 10/319,792, filed on Dec. 13, 2002, now Pat. No. 6,899,186, application No. 13/104,748, which is a continuation-in-part of application No. 11/063,459, filed on Feb. 22, 2005, now Pat. No. 7,131,505, which is a division of application No. 10/331,964, filed on Dec. 30, 2002, now Pat. No. 6,857,487, application No. 13/104,748, which is a continuation-in-part of application No. 10/775,048, filed on Feb. 9, 2004, now Pat. No. 7,311,148.

(60) Provisional application No. 60/657,221, filed on Feb. 28, 2005.

(56) References Cited

U.S. PATENT DOCUMENTS

| | | | | |
|---|---|---|---|---|
| 5,551,521 | A | 9/1996 | Vail, III | |
| 5,845,722 | A | 12/1998 | Makohl et al. | |
| 6,196,336 | B1 * | 3/2001 | Fincher et al. | 175/101 |
| 6,223,823 | B1 * | 5/2001 | Head | 166/290 |
| 6,412,574 | B1 | 7/2002 | Wardley et al. | |
| 6,725,919 | B2 * | 4/2004 | Cook et al. | 166/207 |
| 5,551,521 | A | 9/1996 | Vail, III | |
| 5,845,722 | A | 12/1998 | Makohl et al. | |
| 6,196,336 | B1 * | 3/2001 | Fincher et al. | 175/101 |
| 6,223,823 | B1 * | 5/2001 | Head | 166/290 |
| 6,412,574 | B1 | 7/2002 | Wardley et al. | |
| 6,725,919 | B2 * | 4/2004 | Cook et al. | 166/207 |
| 6,857,487 | B2 | 2/2005 | Galloway et al. | |
| 6,899,186 | B2 | 5/2005 | Galloway et al. | |
| 7,044,241 | B2 * | 5/2006 | Angman | 175/61 |
| 7,048,050 | B2 | 5/2006 | Vail, III et al. | |
| 7,093,675 | B2 | 8/2006 | Pia | |
| 7,100,710 | B2 | 9/2006 | Vail, III | |
| 7,108,083 | B2 | 9/2006 | Simonds et al. | |
| 7,311,148 | B2 | 12/2007 | Giroux et al. | |
| 7,334,650 | B2 | 2/2008 | Giroux et al. | |
| 7,730,965 | B2 | 6/2010 | Jordan et al. | |
| 7,938,201 | B2 | 5/2011 | Giroux et al. | |
| 2003/0056991 | A1 * | 3/2003 | Hahn et al. | 175/61 |
| 2003/0141111 | A1 * | 7/2003 | Pia | 175/57 |
| 2004/0011534 | A1 * | 1/2004 | Simonds et al. | 166/384 |
| 2004/0216925 | A1 * | 11/2004 | Metcalfe et al. | 175/57 |
| 2005/0152749 | A1 * | 7/2005 | Anres et al. | 405/224 |

* cited by examiner 730
700
730
700
700

740
730
701
A = B
700
725
700
745
730
A
B

DEEP WATER DRILLING WITH CASING

CROSS-REFERENCE TO RELATED APPLICATIONS

This application is a continuation of U.S. patent application Ser. No. 11/363,817, filed Feb. 28, 2006, now U.S. Pat. No. 7,938,201; which claims benefit of U.S. Provisional Patent Application Ser. No. 60/657,221, filed on Feb. 28, 2005, which applications are incorporated herein by reference in their entirety.

U.S. patent application Ser. No. 11/363,817 is a continuation-in-part of U.S. patent application Ser. No. 11/140,858, filed on May 31, 2005, now U.S. Pat. No. 7,083,005, which is a continuation of U.S. patent application Ser. No. 10/319,792, filed on Dec. 13, 2002, now U.S. Pat. No. 6,899,186. This application is also a continuation-in-part of U.S. patent application Ser. No. 11/063,459, filed on Feb .22, 2005, now U.S. Pat. No. 7,131,505, which is a divisional of U.S. patent application Ser. No. 10/331,964, filed on Dec. 30, 2002, now U.S. Pat. No. 6,857,487, which patent and applications are incorporated herein by reference in their entirety.

This application is also a continuation-in-part of co-pending U.S. patent application Ser. No. 10/775,048, filed on Feb. 9, 2004, now U.S. Pat. No. 7,311,148 which application is incorporated herein by reference in its entirety.

BACKGROUND OF THE INVENTION

1. Field of the Invention

Embodiments of the present invention generally relate methods and apparatus for drilling a well beneath water. More specifically, embodiments of the present invention relate to methods and apparatus for drilling a deep water well.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. The casing string is cemented into the wellbore by circulating cement into the annular area defined between the outer wall of the casing and the borehole using apparatuses known in the art. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string may then be fixed, or "hung" off of the existing casing by the use of slips which utilize slip members and cones to frictionally affix the new string of liner in the wellbore. The second casing string is then cemented. This process is typically repeated with additional casing strings until the well has been drilled to total depth. In this manner, wells are typically formed with two or more strings of casing of an ever-decreasing diameter.

In the construction of deep water wells, a conductor pipe is typically installed in the earth prior to the placement of other tubulars. Referring to FIG. 1, the conductor pipe 10, typically having a 36" or 30" outer diameter ("OD"), is jetted, drilled, or a combination of jetted & drilled into place. Placement depth of the conductor pipe 10 may be approximately any where from 200 to 500 feet below the mud line 7. As shown in FIG. 1, the conductor pipe 10 is typically carried in from a drill platform 3 on a drill string 12 that has a bit or jetting head 15 projecting just below the bottom of the conductor pipe 10, which is commonly referred to as a bottom hole assembly ("BHA"). The conductor pipe 10 is placed in the earth by jetting a hole and if necessary partially drilling and/or jetting a hole while simultaneously carrying the conductor pipe 10 in. A mud motor 18 is optionally used above the jetting/drilling bit 15 to rotate the bit 15. The conductor pipe 10 is connected to the drill string 12 with a latch 20. See also FIG. 2. Typically a drill string latch 20 fits into a profile collar 22 built into the conductor pipe 10. Once the conductor pipe 10 is jetted and/or drilled to the target depth, a ball is dropped through the drill string 12 from the surface. The ball provides a temporary shut off of the drill string 12 to allow pressurization of the drill string 12 in order to hydraulically release the latch 20 from the conductor pipe 10. (The latch can also be released by pipe manipulation, and not require the dropping of a ball.) Thereafter, fluid flow through the drill string 12 is re-established so that the drill string 12 can drill ahead to create a hole for the next string of casing.

The general procedure for drilling the hole below the conductor pipe to install the structural or surface casing is to drill with a BHA on the end of the drill string used to run the conductor pipe in the hole. Surface casing is casing run deep enough to cover most know shallow drilling hazards, yet the casing is typically located above any anticipated commercial hydrocarbon deposits. The BHA will as a minimum consist of a drilling or jetting bit. The BHA may also contain a mud motor, instrumentation for making geophysical measurements, an under reamer, stabilizers, as well as a drill bit or an expandable drill bit.

The hole is normally drilled with sea water or an environmentally friendly drilling fluid, which is also known as "mud". Sea water or environmentally friendly mud is used because the drilling fluid is allowed to exit into open water at the top of the conductor pipe. This drilling method is generally referred to as riserless drilling (also referred to as the "pump and dump" drilling method). The reason this method is used is because the riser, which is a pipe run from the top of the well at the mud line to the rig, has to be supported at the mud line. In the earlier stages of casing placement, support for the riser is often unavailable. If a riser is in place, the drill string is run inside the riser, thereby forming an annulus between the OD of the drill string and the inside diameter ("ID") of the riser. The annulus provides a path for the drilling fluid to return to the rig during the drilling process. To get the support required to run the riser, the structural casing and/or the surface casing must be in place first.

The surface casing hole is typically drilled to a target depth and then a viscous "pill" made up of weighted and/or thickened fluid is placed in the hole as the drill string is extracted from the hole. The viscous pill is intended to keep any formation or ocean flows from flowing into the drilled hole and to keep the hole from collapsing before the casing is run in the hole. Another purpose of the viscous pill is to keep cement from filling up the rat hole after the surface casing is placed and while it is being cemented in. The rat hole is the difference in depth between the bottom of the casing and the bottom of the hole and is created by drilling deeper than the length of the casing to be run. If cement fills the rat hole, then the next drill string that goes through the cement in the rat hole may core it and the remaining cement, since it is unsupported could fracture and fall in on the drill string, thereby possibly trapping the drill string in the hole.

In some instances, a weighted fluid such as a drilling mud or weighted brine is required to control formation flows of a shallow water flow and/or a shallow gas flow. As an example, if the hole is being drilled at 90 feet per hour and the target depth is 2000 feet, it will take in excess of 22 hours to drill the well, and if the pump rate is 900 gallons per minute during drilling, it will take approximately 1,200,000 gals of weighted fluid to drill the well. Because this occurs during the riserless stage, most of the weighted fluid will be lost to the open water. Due to the cost of weighted fluids, many operators provide the BHA with instrumentation to determine when to switch from sea water to weighted fluid. The primary instrument used is the Pressure While Drilling or "PWD". The PWD will monitor annular pressure to detect a change in pressure that could indicate the drill bit has penetrated a shallow water or gas flow. When that occurs, the drilling fluid is weighted up and pumped down the drill string to the bit. However, for the fluid to be effective in shutting off the flow, enough weighted fluid must be supplied to fill the hole to a level above the bit for the fluid to have enough hydrostatic head to stop the flow. For a 26" ID hole with an 8" OD drill string 25 gallons of fluid per foot is needed to fill the hole. Even with the assistance of PWD, a significant amount of weighted drilling fluid must still be used.

With the conductor pipe at the target depth and the latch released, and the hole drilled for the next casing string the drill string is pulled out of the hole ("POOH") back to the rig floor and the conductor pipe stays in the hole. The conductor pipe is typically not cemented in place.

With the conductor pipe in place and the hole drilled for the next string of casing, the next step may be to install structural pipe or surface casing. Some wells may require structural pipe ahead of the surface casing. The structural pipe is typically placed in a well to help mitigate a known drilling hazard (s), e.g., shallow water flow, shallow gas flow, and low pore pressure. Wells with these types of drilling hazards tend to fracture when the minimum drilling fluid weight needed to control shallow water flows and/or shallow gas flows is used. Structural pipe may also help support the wellhead.

Running large diameter casing in a predrilled hole presents several challenges. One such challenge arises when the hole has low formation pore pressure. In that instance, running the casing too fast could surge the well, i.e., put excessive pressure on the bore of the well, and cause the bore hole to fracture or break down a surrounding earth formation. Typically, breaking down or fracturing the formation causes the formation to absorb fluid. The normal method of keeping the surge pressures low is to run the casing slowly. On drilling rigs, the extra time needed to run the casing may substantially increase the operating cost.

A need, therefore, exists for apparatus and methods of running casing into the earth below water. There is also a need to quickly drill and case a well, preferably in a single trip.

SUMMARY OF THE INVENTION

Methods and apparatus are provided to place a conductor pipe and a casing in a subsea environment. In at least one embodiment, a conductor pipe is jetted or drilled into the subsea floor. Thereafter, a casing drilling assembly comprising a drill casing and a drilling assembly is connected to the drill pipe using a crossover. The drilling assembly urged into the seafloor until a casing latch on the drilling assembly is engaged with a casing profile of the conductor pipe. During drilling, instrumentation in the drilling assembly may be used to measure geophysical data. The measured data may be used to optimize the drilling process. After the drill casing is engaged with the conductor pipe, cementing may be performed to set the drill casing.

In another embodiment, the conductor pipe and the casing may be placed into the earth as a nested casing strings assembly. A casing latch is used to couple the casing to the conductor pipe. In this respect, the conductor pipe rotated with casing during drilling. After conductor pipe is placed at target depth, the casing is released from the conductor pipe and is drilled further into the earth. In one embodiment, the casing is drilled until a wellhead on the casing is engaged with a wellhead of the conductor pipe. In another embodiment, a collapsible joint is provided on the casing to facilitate the engagement of the casing wellhead with the wellhead of the conductor pipe.

In another embodiment, the conductor pipe and the drill casing are connected together to form a combination string. The conductor pipe and the drill casing are mated at the surface in the same arrangement as their final placement in the hole. In this respect, this embodiment does not require casing latch between the conductor pipe and the drill casing. A drill pipe and a drilling latch may be used to rotate the combination string to drill the hole in which the string will be place. The combination string is cemented in place after the hole is drilled. Preferably, the cement occurs before the drill latch in the drill casing is released. In this case, both the conductor and drill casing will be cemented in place after the hole is drilled and before the drill latch in the drill casing is released.

In yet another embodiment, a method of lining a wellbore comprises positioning a first casing in the wellbore, providing a drilling assembly; lowering the drilling assembly into the first casing; and coupling the second casing to the first casing. Preferably, the drilling assembly includes a second casing; a conveying member; a tubular adapter for coupling the conveying member to the second casing, wherein the tubular adapter is adapted to transfer torque from the conveying member to the second casing; and a drilling member disposed at a lower end of the second casing.

In yet another embodiment, a method for lining a portion of a wellbore comprises rotating a casing assembly into the wellbore while forming the wellbore, the casing assembly comprising an outer casing portion and an inner casing portion wherein the outer and inner casing portions are operatively connected; disabling a connection between the inner casing portion and the outer casing portion; and lowering the inner casing portion relative to the first casing portion.

In yet another embodiment, an apparatus for lining a wellbore comprises a casing; a drilling member disposed at a lower end of the casing; a conveying member; and a tubular adapter for coupling the conveying member to the casing.

In yet another embodiment, a method of lining a wellbore comprises positioning a first casing in the wellbore; providing a drilling assembly having a second casing and a drilling member; forming a wellbore using the drilling assembly; connecting a conveying member having a diameter less than the second casing to the second casing, wherein a tubular adapter is used to couple the conveying member to the second casing; providing a casing hanger on the second casing; and coupling the second casing to the first casing.

In yet another embodiment, a method for lining a wellbore includes drilling a casing to a first depth; coupling the casing to a drill pipe; drilling the casing to a second depth; coupling a retaining assembly to the casing; and lowering and coupling the retaining assembly to a wellhead. In one embodiment, a distance from the first depth to the second depth is equal to a distance from a mud line to a rig floor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide a method of placing casing in the earth beneath the water. In one embodiment, the method involves using casing as part of the drill string. In particular, the method involves drilling with casing in deep water.

In situations where the water depth is deeper than the length of drill casing being run, the drill string may be extended by adding drill pipe. In this respect, a connection crossover is used to connect the smaller diameter drill pipe to the casing. The crossover is adapted to transmit torque, axial, and tensile load from the drill pipe to the casing. The crossover is also adapted to detach from the casing to permit retrieval of the drill pipe and the crossover after the casing is placed at the desired location.

Figure 1:
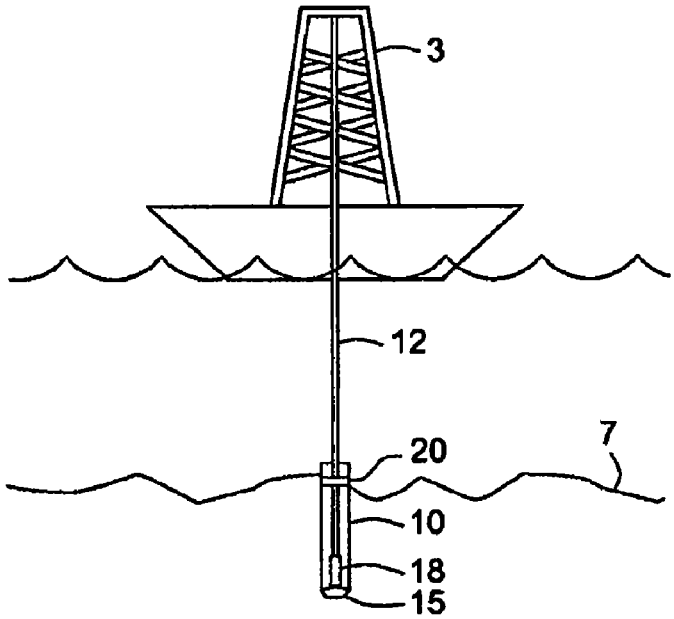
FIG. 1 is a schematic view of the process of placing a conductor pipe into the earth beneath the water.
Figure 2:
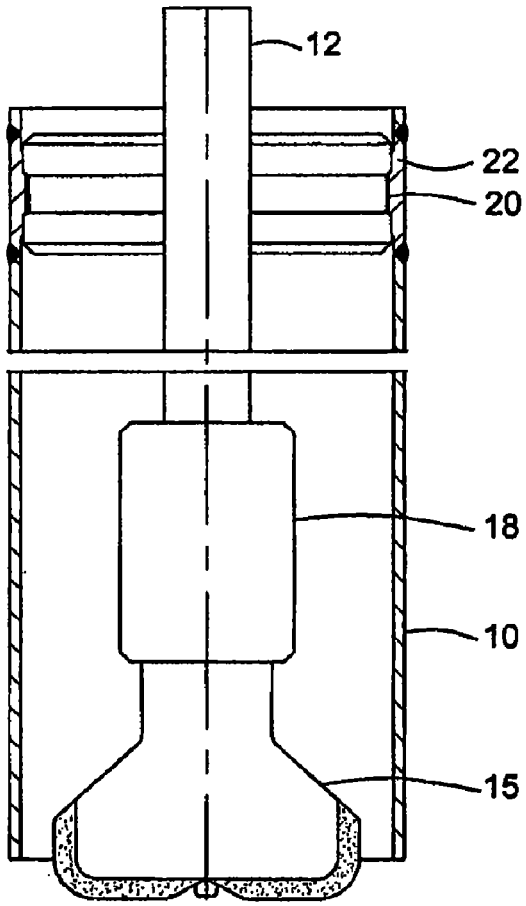
FIG. 2 is a schematic view of a drill pipe coupled to a conductor pipe.
Figure 3:
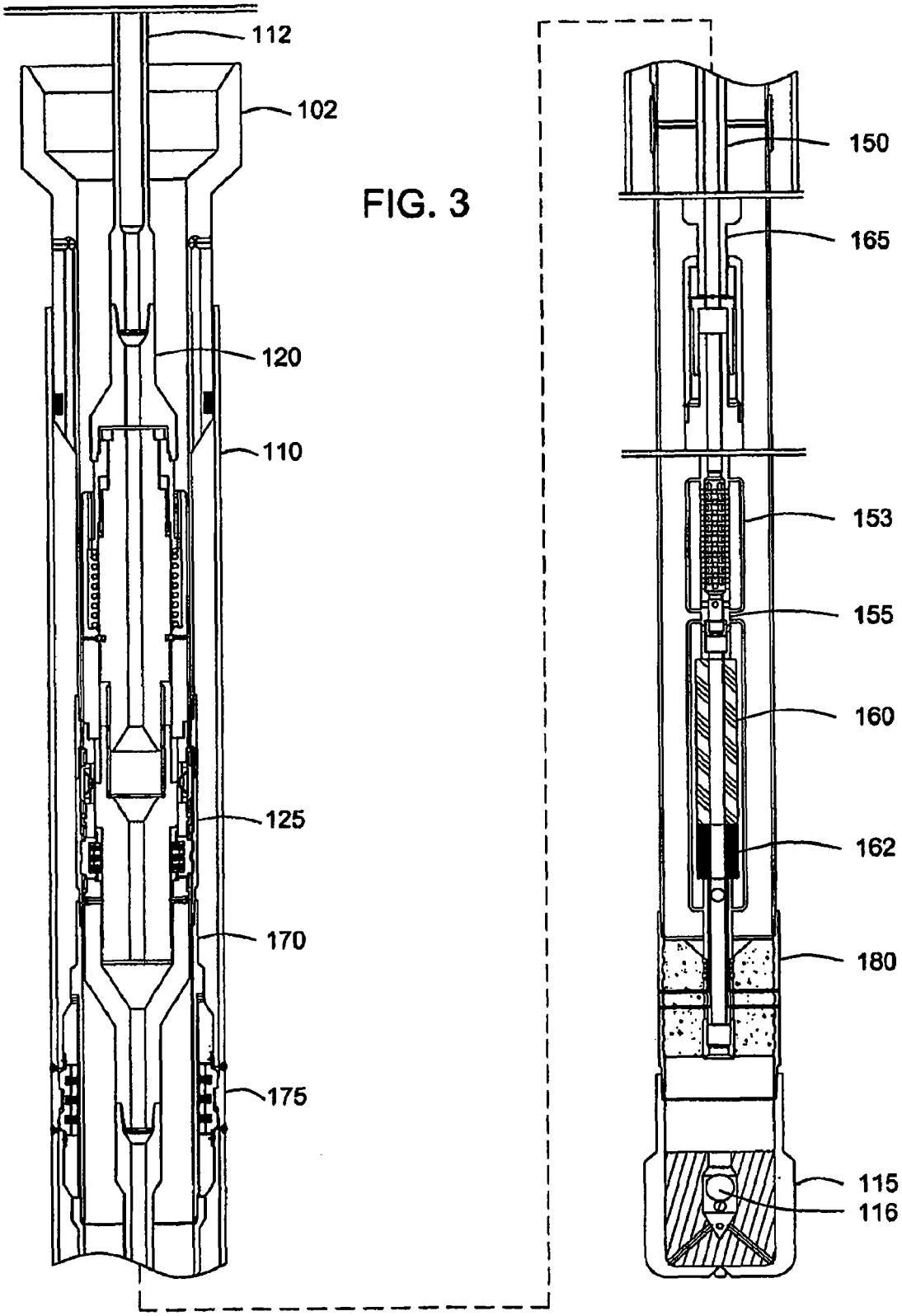
FIG. 3 shows an embodiment of a casing drilling assembly for positioning a casing in another casing. In this embodiment, a drilling latch is used as a crossover.
Figure 4:
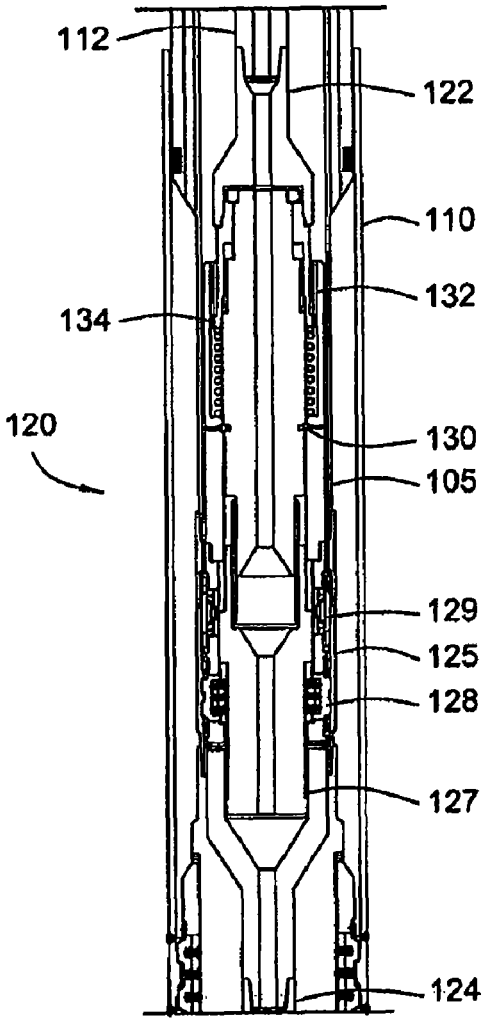
FIG. 4 is section view of a drilling latch engaged with a drilling profile.

In one embodiment, a drilling latch 120 is used to facilitate the positioning of the drill casing 105 in the previously run conductor pipe 110 and drilling below the conductor pipe 110, as illustrated in FIG. 3. The drilling latch 120 is connected to the drill pipe 112 and run below the wellhead 102. The drilling latch 120 is adapted to engage a drilling profile 125 formed on the inner surface of the casing 105, thereby coupling the drill pipe 112 to the casing 105. FIG. 4 shows a more detailed view of the drilling latch 120. It should be appreciated that the drilling profile 125 could be formed in a casing collar or the casing 105, and may be located anywhere in the casing 105 or wellhead assembly 102.

Figure 3A:
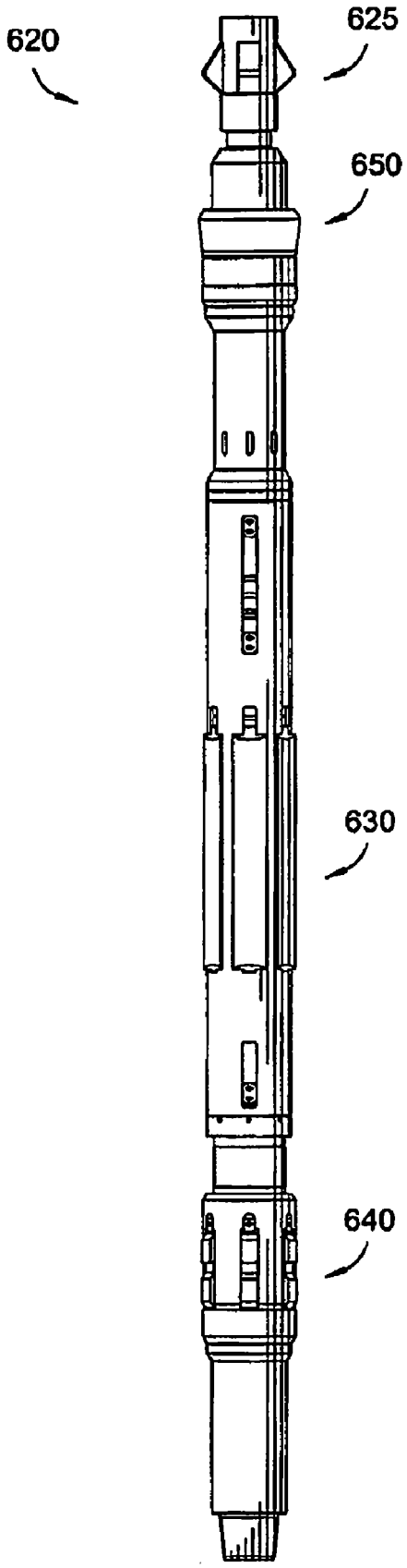
FIG. 3A shows an exemplary drilling latch suitable for use with embodiments of the present invention.

One exemplary drilling latch usable with the embodiment shown in FIG. 3 is disclosed in U.S. Patent Application Publication No. 2004/0216892, filed by Giroux et al. and entitled "Drilling With Casing Latch," which is incorporated herein by reference in its entirety. FIG. 3A illustrates a drilling latch 620 suitable for use with the embodiments disclosed herein. The drilling latch 620 includes a retrieval assembly 625, a cup assembly 650, a slip assembly 630, and a latch assembly 640. In operation, the latch assembly 640 is activated to engage a mating profile in the casing, thereby coupling the casing to the drill pipe. Also, the slip assembly 630 is activated to engage the casing such that torque and axial force may be transmitted from the drill pipe to the casing.

The operation of the drilling latch 120 shown in FIGS. 3 and 4 is similar to the casing while drilling latch of Giroux et al. Referring to FIGS. 3 and 4, an upper portion 122 of the drilling latch 120 connected to the drill pipe and a lower portion 124 of the drilling latch 120 is connected to the interstring 150. In an alternative embodiment, the lower portion 124 may be connected to a subsurface release ("SSR") plug sub assembly. As shown, the drilling latch 120 is engaged with the drilling profile 125 of the casing 105. In operation, the mandrel 127 is pushed under the axial locking keys 128 by weight and is locked in position by the snap ring 130. The torque from the drill pipe 112 is supplied by a spline 132 to the body holding the torque and by the torque keys 129. As long as the drill casing 105 is in tension where the drilling latch is located, the spline 132 is engaged. When weight can be slacked off and the drill latch 120 is in compression, e.g., after the cement has set or the external casing latch 170 has engaged the casing profile 175 in the previously run casing 110, then the drilling latch 120 can be released.

The drill latch 120 is released by setting weight down, which causes the clutch 134 in the drill latch 120 to release from the spline 132. The drill pipe 112 is then rotated thus transmitting the rotation to the locking mandrel 127 to cause it to move up and release the axial keys 128. With the axial keys 128 released, the drill pipe 112 is picked up and the drilling latch 120 disengages from the drilling profile 125 in the drill casing 105. The drill pipe 112, drilling latch 120, and anything below the drilling latch 120, e.g., interstring 150, top of SSR sub assembly, bottom hole assembly, instrumentation, are then pulled out of the hole ("POOH").

Figure 5:
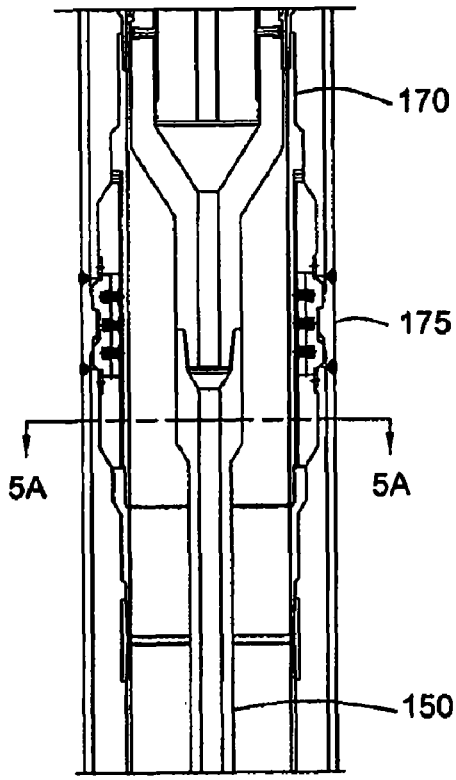
FIG. 5 is a section view of a casing latch engaged with a casing profile.
Figure 5A:
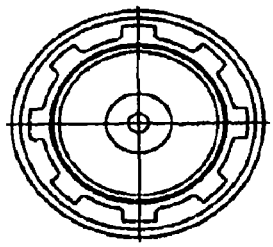
FIG. 5A is a cross-section view of the casing latch.

The drilling latch 120 may be released when the casing 105 is supported by the previously run conductor pipe 110. In that respect, the exterior portion of the casing 105 includes a casing latch 170 adapted to engage a casing profile 175 formed on the inner surface of the conductor pipe 110, as shown in FIGS. 3 and 5. The casing latch 170 will engage the casing profile 175 once the casing 105 has reached a predetermined depth. After engagement, the casing latch 170 will lock the casing 105 axially relative to the conductor pipe 110. Also, the casing latch 170 is non-rotating after engagement such that the casing latch 170 does not rotate with the drill casing 105 when torque is transferred from the drill pipe 112 and the drilling latch 120 to the casing 105. Another feature of the casing latch 170 is that it is adapted to create a rat hole. In operation, a mandrel under the casing latch 170 is allowed to move up in relation to the casing latch 170 when the drill casing 105 is being picked up from the surface. At the end of the pick up stroke, the mandrel is locked up and can not move back down. At this point, the casing latch 170 may be disengaged from the casing profile 175, if desired. When the casing latch 170 is set back down into the casing profile 172, the downward travel of the drill casing 105 is reduced by the distance traveled by the mandrel in order to lock up, thereby creating the rat hole. In addition, the casing latch 170 is provided with a cement by-pass area, as illustrated in cross-section view of the casing latch 170 in FIG. 5A.

Several advantages may be achieved using the drilling latch 120. First, the drilling latch provide an effective method to run a bottom hole assembly at the bottom of the drill casing that's couple to an interstring and to recover the interstring and the BHA without dropping the drill casing before cementing. Second, the drilling latch allows a rat hole to be created using a drill shoe and thereafter release from the drill casing without having to wait for the cement to set up. Third, the drilling latch provides an efficient method of finding the planned depth of the hole without depending on pipe tally. Fourth, the drilling latch allows the pipe to grow and not shut off on the bottom of the hole during cementing. This is advantageous because in some cementing operations, a casing string will elongate due to the weight of the cement inside the casing, particularly in SSR plug jobs. This elongation may cause the bottom of the drill casing to "jam" into the bottom of the hole and shut off flow and cause a failure.

In another embodiment, the crossover may comprise a liner running tool adapted to run and rotate a liner for drilling or reaming the liner into the hole. An exemplary liner running tool designed for transmitting torque to a casing drill string is disclosed in U.S. Pat. No. 6,241,018, issued to Eriksen, which patent is assigned to the same assignee of the present application and is incorporated herein by reference in its entirety. A running tool suitable for such use is manufactured by Weatherford International and sold under the name "R Running Tool." Another exemplary liner running tool is disclosed in U.S. Pat. No. 5,425,423, issued to Dobson, et al., which patent is incorporated herein by reference in its entirety. In one embodiment, the running tool includes a mandrel body having a threaded float nut disposed on its lower end to engage a tubular. The running tool also includes a thrusting cap having one or more latch keys disposed thereon which are adapted to engage slots formed on the upper end of the tubular. The thrusting cap is selectively engageable to the mandrel body through a hydraulic assembly and a clutch assembly which is engaged in the run-in position. The hydraulic assembly can be actuated to release the thrusting cap from rotational connection with the mandrel body to allow the threaded float nut to be backed out of the tubular. The clutch assembly is disengaged when the tool is in the weight down position. A torque nut moves down a threaded surface of the thrusting cap to re-engage the thrusting cap and transmit torque imparted by the mandrel body from the drill string to the thrusting cap.

Figure 6:
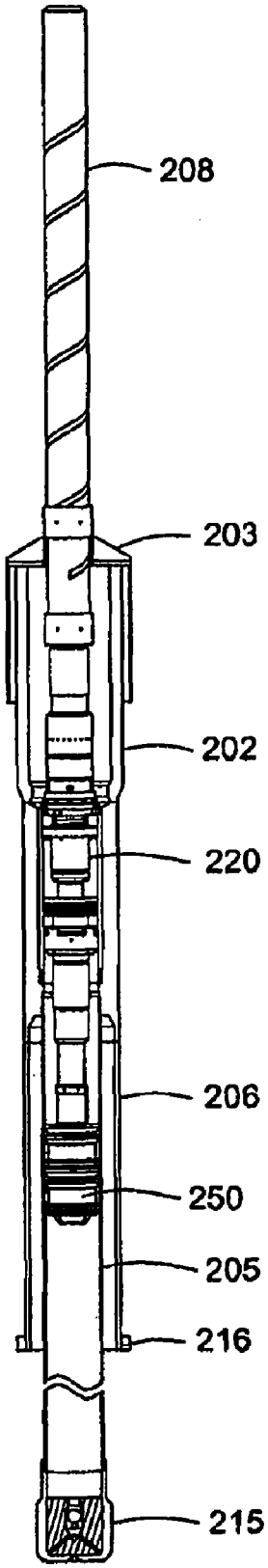
FIG. 6 shows another embodiment of a casing drilling assembly for positioning a casing in another casing. In this embodiment, a running tool is used as a crossover.

Referring to FIG. 6, the running tool 220 is engaged with the drill casing 205 at a location below the wellhead 202. A protective bonnet is 203 is located at the top of the wellhead 202 to facilitate the coupling of the running tool 220 to the casing 205. In one embodiment, the running tool 220 is optionally coupled to the drill pipe using a spiral joint 208. The spiral joint 208 allows for adjustment of the bonnet 203 to the top of the wellhead 202. An outer support casing 206 extends below the wellhead 202 and surrounds the casing 105. Below the running tool 220 is a subsurface release cementing plug set 250. An optional isolation cup 224 may be connected to the running tool 220 to keep pumped fluid in the casing 205. A drill shoe 215 is positioned at the lower end of the drill casing 105. The drill shoe 215 can be rotated to extend the wellbore. The outer support casing 206 may optionally include a coring shoe 216 to facilitate the lowering of the outer support casing 206 during drilling.

In the preferred embodiment, the wellhead is modified with a collar to facilitate the transmission of torque and axial forces from the casing to the drill pipe. In one embodiment, the collar includes a spline to allow rotation and a recess in the inner diameter that will catch a collet or locking dogs to allow transmission of the axial load from the wellhead to the drill pipe.

Figure 7:
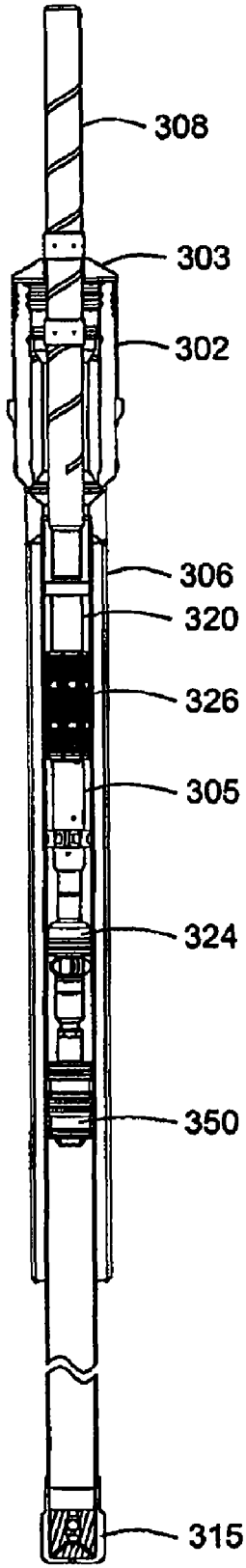
FIG. 7 shows another embodiment of a casing drilling assembly for positioning a casing in another casing. In this embodiment, a spear is used as a crossover.

An alternative crossover may comprise a drilling and/or fishing spear. An exemplary spear suitable for use with embodiments of the present invention is disclosed in U.S. Patent Application Publication No. 2005/0269105, filed by Pietras, which application is incorporated herein by reference in its entirety. FIG. 7 shows another embodiment of a spear 320 suitable for running and rotating the drill casing 205. The spear 320 is engaged with the drill casing 305 at a location below the wellhead 302. A spiral joint 308 is used to facilitate coupling of the protective bonnet 303 to the top of the wellhead 302. An outer support casing 306 extends below the wellhead 302 and surrounds the casing 105. Below the spear 320 is a subsurface release cementing plug set 350 and an optional isolation cup 324. A drill shoe 315 is positioned at the lower end of the drill casing 205. The spear 320 is shown engaged with the ID of the casing 305 using a gripping member such as slips 326. Once engaged, the spear 320 may transmit torque, tensile, and compression from the drill pipe to the casing 305. The spear 320 may be activated or de-activated using fluid pressure or electrical power supplied internally by batteries or by line(s) from the surface. The spear 320 may also be mechanically operated, in that it works with a mechanical "J" slot to activate and de-activate the slips 326. In use, the mechanical spear 320 is activated by select mechanical movement from the surface to cause release of the slips 326 by un "J" ing the spear 320. De-activation can be additional pipe manipulation to re "J" the spear 320 and move the slips 326 to a non-gripping position.

In another embodiment, a drill pipe crossover designed to engage to the ID and/or the OD of the wellhead is used to carry the casing into a predrilled hole. The drill pipe crossover is adapted to transmit torque to the casing. In one embodiment, the crossover comprises a threaded crossover having one end adapted to threadedly engage the drill casing and another adapted to threadedly engage the drill pipe. This threaded crossover has been referred to as a swedge, an adapter, and a "water bushing." In use, the wellhead crossover is rotated by the drill pipe, thereby rotating the casing to extend the wellbore.

Bottom Hole Drilling Assembly Options

Referring back to FIG. 5, the drill casing 105 is equipped with a drill shoe 115 at its lower end. As shown, the drill shoe 115 includes a float valve 116 disposed in its interior to assist in regulating fluid flow through the drill shoe 115. In instances where directional drilling is desired, the drill shoe 115 may comprise a nudging bit and/or a bent joint of casing biased to drill in a selected direction. Exemplary nudging bit and bent joint of casing are disclosed in U.S. Patent Application Publication No. 2004/0245020, filed by Giroux et al., which application is incorporated herein by reference in its entirety. In one embodiment, the nudging bit may comprise one or more fluid nozzles adapted to direct fluid out of the nudging bit in the desired direction of the wellbore. In another embodiment, a bend is provided on the casing to create a directional force for directionally drilling with the casing.

Alternatively, the wellbore may be drilled using a bottom hole assembly located at the lower end of the casing having at least a drill bit. In one embodiment, the drill bit may comprise a pilot bit, an underreamer, and/or reamer shoe. The under reamer may be any device capable of enlarging the hole to a diameter great than the casing diameter, for example, expandable bits. An exemplary expandable bit is disclosed in U.S. Pat. No. 6,953,096, issued to Gledhill, which patent is incorporated herein by reference in its entirety. The bottom hole assembly may also include a mud motor and directional steering equipment such as a bent housing motor, a bent casing joint steering system, an eccentric casing joint, a dynamic steering system, a surface telemetry directed steering system, and a 3D rotary steerable system. The bottom hole assembly may further include instrumentation capable of taking geophysical measurements such as annulus pressure and temperature, making physical measurements in real time, and sending these measurements to the surface using methods such as mud pulse telemetry. These components of the bottom hole assembly may be located below the distillate end of the drill casing or inside the casing. Preferably, these components, unless they are an integral part of the drill casing, should be able to pass through the ID of the drill casing. Exemplary configurations of a bottom hole assembly are disclosed in U.S. Patent Application Publication No. 2004/0221997, filed by Giroux et al., which application is incorporated herein by reference in its entirety.

Cementing Options

At least two cementing options exist when using a drill shoe. In the first option, a subsurface release (SSR) plug assembly 250, 350 may be installed below the crossover 220, 320 between the drill pipe and the drill casing, as illustrated in FIGS. 6 and 7. Use of SSR plug assemblies is known in the industry and thus will not be discussed in detail herein. In the second option, an interstring 150 is used to perform the cementing job as illustrated in FIG. 3. It must be noted that SSR plugs may also be run below the drilling latch 120 instead of the interstring 150, if desired. In this respect, it is contemplated that the various options provided herein such as options for cementing and options for bottom hole assembly, may be interchangeable as is known to a person of ordinary skill in the art.

As shown in FIG. 3, the interstring 150 couples the drilling latch 120 to the instrument package 160, 162, instrument float collar 180, and the drill shoe 115. The interstring includes 150 a plug/ball catcher 153, a cement by-pass valve 155, and a cement by-pass 167. When a ball is dropped from the surface to close off the center flow path through the instrument package such as a LWD system or a MWD system 160, memory and inclination gage 162, or other tools, fluid is urged through the by-pass valve 155 and is by-passed to flow on the outside of the package 160, 162. The ball/plug catcher tool 153 is adapted to catch balls and/or darts pumped ahead and behind fluid spacers and cements to provide a pressure indication at the surface when the pumped fluid reaches the bottom of the string. When the ball(s) and/or dart(s) encounters a restricted ID above the catcher tool 153, a predefined pressure is required to pump the ball and/or dart through restricted ID, thereby providing the pressure indication. It must be noted that shutting off the flow around the instrument package does not stop the memory gage from continuing to collect data from the instrumented float collar or from it's integral sensors. The collected information may be analyzed after the gage is recovered at the surface.

Another feature of the interstring 150 is a pressure and volume balance length compensator 165. The length compensator 165 allows the interstring 150 to stab-in properly and takes up any excessive length between the stab-in point and the place where the drilling latch 120 attaches to the drill casing 105. The fact the length compensator 165 is both pressure and volume balanced means any change in internal and/or external pressure will not shorten or extend the interstring 150. Such a length compensator is shown and described in United States Patent Application No. 2004/0112603 and U.S. Pat. No. 3,329,221, which are incorporated herein by reference in their entirety.

Use of the interstring 150 provides several benefits. First, because the interstring 150 has a smaller diameter, the interstring 150 allows for quick transport of fluids from the surface to the drill shoe 115. Use of the interstring 150 this simulates drilling with drill pipe. Thus, if a mud weight change is necessary, then pumping the mud down an interstring 150 is the quickest way to the bottom of the hole. Second, the interstring 150 reduces the volume of mud needed because the volume of mud in the ID of the interstring 150 is typically much less than that needed in the ID of a drill casing string 105 without the interstring 150. This should not be confused with the benefit of using drill casing 105 to reduce the volume of mud needed on the outside of the pipe, thereby reducing the total amount of mud needed on location to control the well. Also, leaving the casing 105 in the hole and cementing in one trip eliminates the need for a kill pill mixture to control the well after the hole is drilled and the drill pipe POOH and before the casing 105 is run. The interstring 150 reduces the amount of cement needed and the length of time it takes to cement a well. Third, the interstring 150 allows for instrumentation using current technology near the bottom of the string that can send real time readings back to the surface so the operator can make decisions as the well is being drilled.

When a bottom hole assembly is used below the casing 105, a preferred method is to retrieve the drill pipe 112 to drill casing crossover, and retrieve the interstring 150 and the BHA before cementing the drill casing 105 in place. This requires that the drill casing 105 be hung off in previously run pipe or casing 110 before releasing the crossover from the drill casing 105 and retrieving the interstring 150. Although a liner hanger may be used, a preferable arrangement includes use of the non-rotating casing latch 170 run on the outside of the drill casing 105. See FIG. 5. As discussed above, this casing latch 170 will set in a casing profile 175 of the previously run pipe or casing 110. In operation, with the casing latch 170 initially set, the drill casing 105 is picked up a few feet and then set back down in the casing profile 175. This pick-up and set down motion allows a mandrel under the casing latch 17 to move up under the casing latch 170 and permanently lock after traveling a select distance of travel, for example, 3 feet. That travel distance creates a rat hole at the bottom of the BHA, and puts the crossover between the drill casing 105 and drill pipe 112 in tension. Placing the crossover in tension facilitates the release of the interstring 150 and the BHA from the drill casing 105 for retrieval.

Figure 8:
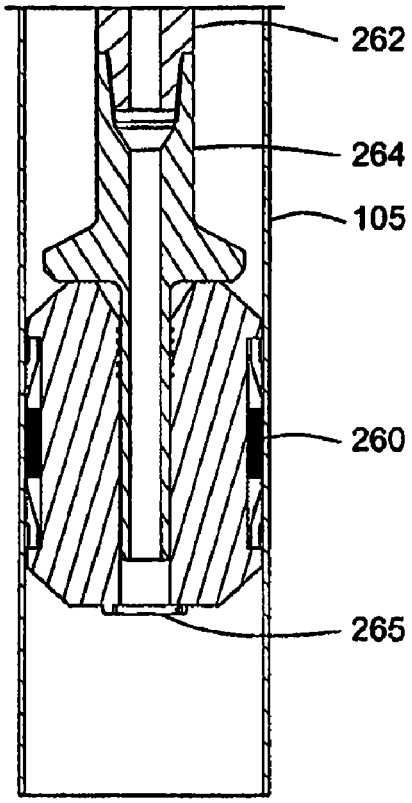
FIG. 8 shows a drilling packer positioned in a drill casing.

With the interstring 150 out of the way, a drillable packer 260 is set with wire line or drill pipe 262 near the bottom of the drill casing 105. In one embodiment, the drill pipe 262 may include a stinger 264 for attachment to the drillable packer 260. Cement is then pumped through the drillable packer 260 and to the annulus behind the drill casing 105. See FIG. 8. This method allows the circulation of the cement in the annulus between the OD of the drill casing 105 and the ID of the drilled hole and the ID of the previously run casing. The drillable packer 260 may include a flapper valve 265 to regulate the flow of cement. If the annulus can not be circulated for the placement of cement in the annulus, then the bottom and top of the casing can be squeezed off using conventional squeeze techniques.

Figure 10:
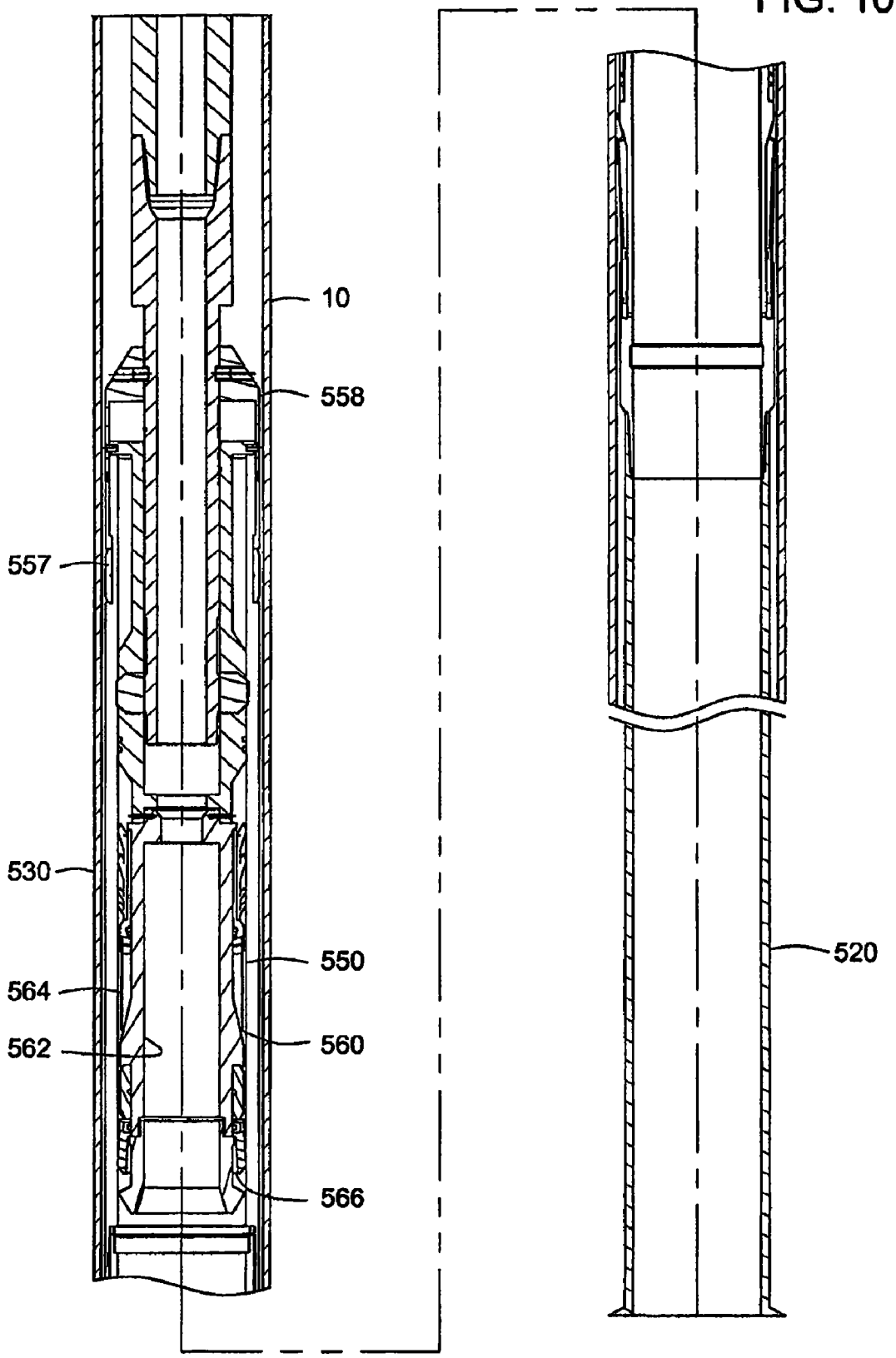
FIG. 10 shows an embodiment of a single direction plug before release.
Figure 11:
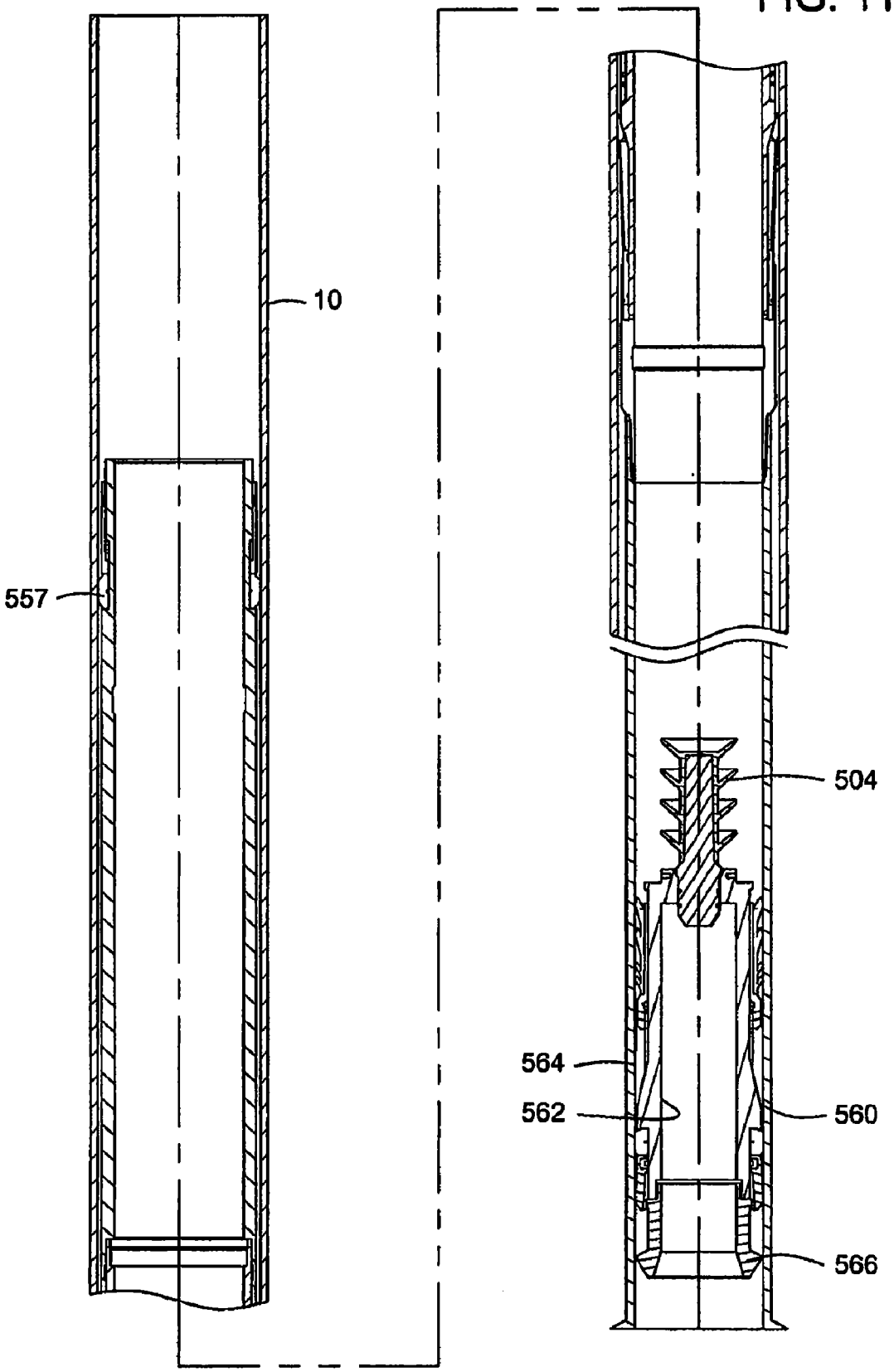
FIG. 11 shows an embodiment of the single direction plug of FIG. 10 after release.

Alternatively, a liner top system with a SSR type plug set may be used for cementing. The plugs are launched by pumping or dropping darts or balls down the drill pipe. The top plug may be the single direction cementing plug described in U.S. Patent Application Publication No. 2004/0251025 or U.S. Patent Application Publication No. 2004/0251025, which applications are incorporated herein by reference in their entirety. In FIG. 10, the plug 560 includes a body 562 and gripping members 564 for preventing movement of the body 562 in a first axial direction relative to the tubular. The plug 560 further includes a sealing member 566 for sealing a fluid path between the body 562 and the tubular. Preferably, the gripping members 564 are activated by a pressure differential such that the plug 560 is movable in a second axial direction with fluid pressure but not movable in the first direction due to the fluid pressure. FIG. 10 shows the plug 560 in the unreleased position. FIG. 11 shows the plug 560 after release by a dart 504 and the gripping members 564 engaged with the tubular. The single direction top plug may stay inside the casing to help keep the pumped cement from u-tubing.

Instrument Float Collar

Figure 9:
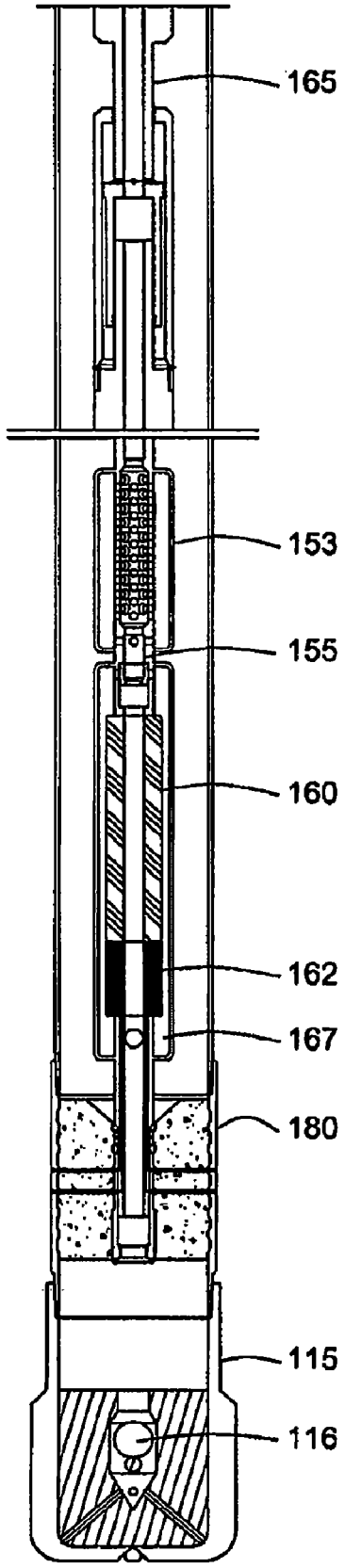
FIG. 9 is a section view of a lower portion of the casing drilling assembly of FIG. 3.

Referring now to FIGS. 3 and 9, an instrument float collar 180 is provided at the lower portion of the casing string 105 and is adapted to measure annulus pressure and temperature. The instrument float collar 180 includes probes or sensors to take geophysical measurements and is attached to the float equipment, a part of the interstring, or a part of the outer casing, or anywhere downhole for this application. One advantage is that the downhole geophysical sensors, mainly annular pressure and temperature sensors, may be used to identify wellbore influxes at the earliest possible moment. In one embodiment, the geophysical sensors are disposable or drillable sensors. Alternatively such geophysical sensors may be attached to the interstring and retrieved on the drill pipe. Other sensors may be added to measure flow rate. The information from the sensors may be fed to a battery powered memory system or flash memory. Such a memory system may have a built in or a separately packaged inclination gage or geophysical sensor. The information being stored by the memory system may also be fed to the surface by mud pulse technology or other telemetry mechanisms such as electromagnetic telemetry, wire or fiber optic line. Information transmitted to the surface may be processed with software to determine actual drilling conditions at or near the bit and the information used to control a closed loop drilling system. Also, the information may be processed downhole to form a closed-loop drilling system. This type of instrumentation help determine if the hole is being drilled straight, if there is an inflow into the hole from a shallow water and/or gas flow, or if the cuttings are increasing the equivalent circulation density possibly causing the hole to break down. Further, use of the geophysical sensors assist in identifying the type of formation being drilled and possibly the type of formation in front of the bit if a "look ahead" probe, such as sonic, is used. The sensors may indicate if the drilling fluid weight is correct and the hole is under control with no unplanned in flows or out flows. If the memory system or sensor is left in the hole after the cement has been placed, it may collect information regarding the setting of cement. This information may be retrieved after the memory system is recovered at the surface or in real time. The sensors may also indicate premature loss of hydrostatic head so that in flows which may cause cementing problems can be detected early.

Methods of Drilling with Casing in Deep Water

Method 1

After the conductor pipe 110 is placed at target depth, embodiments of the present invention may be used to install casing. In one embodiment, the casing 105 is equipped with a drilling assembly 115 and is connected to the drill pipe 112 through the drilling latch 120, as illustrated in FIGS. 3 and 4. The drilling assembly is used to drill the hole for the drill casing 105 until the casing latch 170 is engaged with the casing profile 175 of the conductor pipe 110. The casing drilling assembly may further include instrumentation to measure geophysical data during drilling. The measured data may be used to optimize the drilling process. After the drill casing 105 is engaged with the conductor pipe 110, cementing may be performed as describe above depending on which drilling assembly is used.

Method 2

Figure 12:
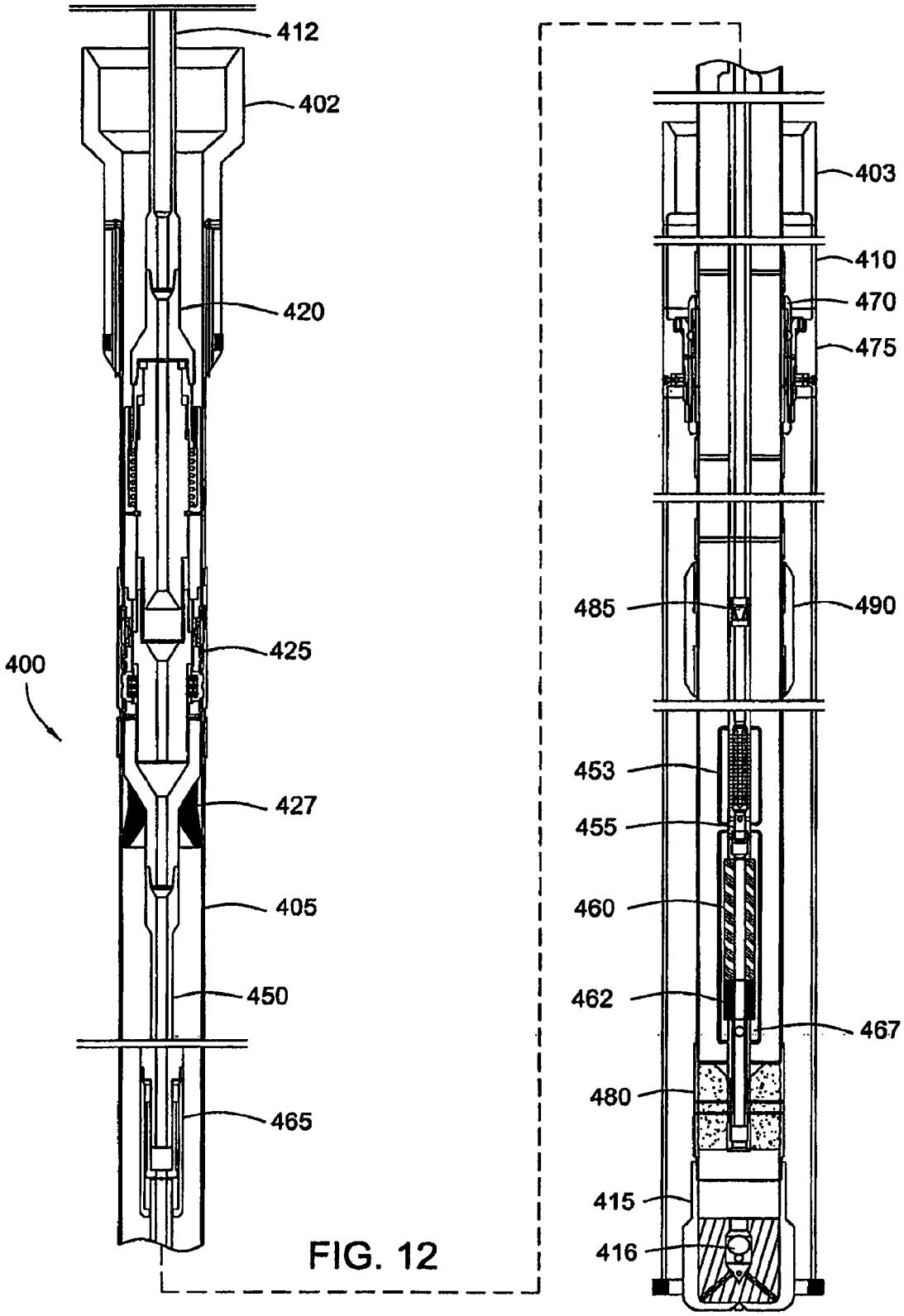
FIG. 12 shows another embodiment of drilling with casing assembly in deep water prior to drilling.

Another method of drilling with casing in deep water uses a nested casing strings assembly, as shown in FIG. 12. Examples of nested strings of casing are described in U.S. Pat. No. 6,857,487, issued to Galloway, et al.; U.S. Patent Application Publication No. 2004/0221997, filed by Giroux et al.; and U.S. Patent Application Publication No. 2004/0245020, filed by Giroux et al., which patent and applications are incorporated herein by reference in their entirety. In FIG. 12, the nested casing string assembly 400 includes a drill casing 405 coupled to an outer casing, which may be a conductor pipe 410. A casing latch 420 is used to couple the drill casing 405 to the conductor pipe 410 and to transmit torque, tensile, and compression loads from the drill casing 405 to the conductor pipe 410. In this respect, the conductor pipe 410 is rotatable with the drill casing 405 during drilling. The lower end of the conductor pipe 410 is equipped with a cutting structure 416 to facilitate the drilling process. The upper portion of the conductor pipe 410 is equipped with a low pressure wellhead 403 adapted to receive a high pressure wellhead 402 that is attached to the drill casing 405.

Figure 15:
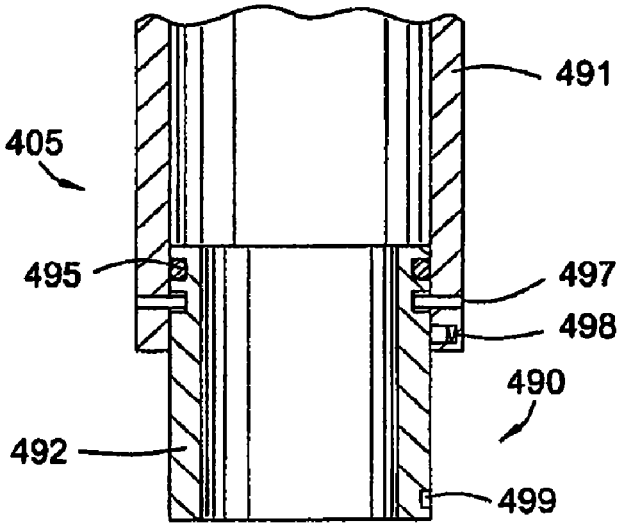
FIG. 15 shows an embodiment of a collapsible joint.
Figure 16:
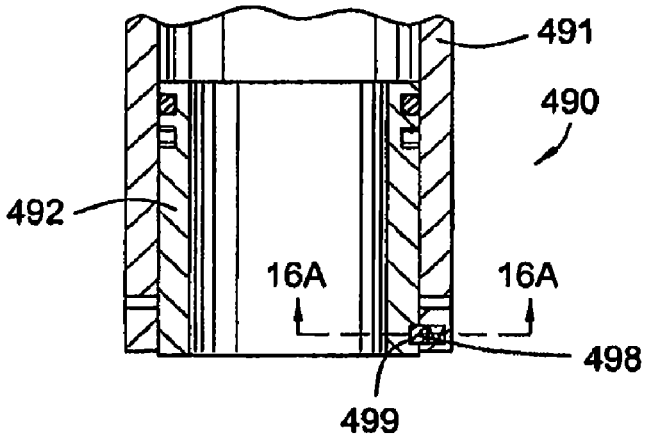
FIG. 16 shows the collapsible joint of FIG. 15 in the collapsed position.

A collapsible joint 490 is provided on the drill casing 405 to facilitate the engagement of the high pressure wellhead 402 with the low pressure wellhead 403. In the event that the advancement of the drill casing 405 is stop before engagement of the wellheads 402, 403, the collapsible joint 490 may be activated to reduce the length of the drill casing 405, thereby allowing the high pressure wellhead 402 to land in the low pressure wellhead 403. An exemplary collapsible joint is disclosed in U.S. Pat. No. 6,899,186, issued to Galloway et al., which patent is incorporated herein by reference in its entirety. In one embodiment, the collapsible joint 490 comprises a joint coupling an upper casing portion 491 to a lower casing portion 492 of the drill casing 405, as shown in FIG. 15. FIG. 15 is a cross-view of collapsible joint 490 only. The collapsible joint 490 includes one or more seals 495 to create a seal between the upper casing portion 491 and the lower casing portion 492. Preferably, the joint 490 is located at a position where a sufficient length of the drill casing 405 may be reduce to enable the high pressure wellhead 402 to seat properly in the low pressure wellhead 403. The lower casing portion 492 is secured axially to the upper casing portion 491 by a locking mechanism 497. The locking mechanism 497 is illustrated as a shear pin. However, other forms of locking mechanisms such as a shear ring may be employed, so long as the locking mechanism 497 is adapted to fail at a predetermined force. The locking mechanism 497 retains the lower casing portion 492 and the upper casing portion 491 in a fixed position until sufficient force is applied to cause the locking mechanism 497 to fail. Once the locking mechanism 497 fails, the upper casing portion 491 may then move axially downward to reduce the length of the drill casing 405. Typically, a mechanical or hydraulic axial force is applied to the drill casing 405, thereby causing the locking mechanism 497 to fail. Alternatively, a wireline apparatus (not shown) may be employed to cause the locking mechanism 497 to fail. In an alternative embodiment, the locking mechanism 497 is constructed and arranged to deactivate upon receipt of a signal from the surface. The signal may be axial, torsional or combinations thereof and the signal may be transmitted through wired casing, wireline, hydraulics or any other manner known in the art. FIG. 16 shows the drill casing 405 after collapse, i.e., reduction in length. An exemplary wired casing is disclosed in U.S. Patent Application Publication No. 2004/0206511, issued to Tilton, which application is incorporated herein by reference in its entirety.

Figure 16A:
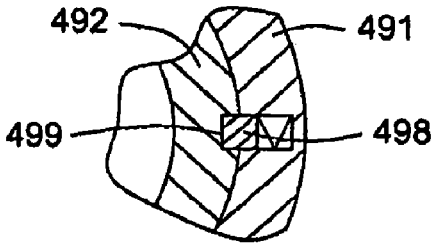
FIG. 16A shows a torque connection of the collapsible joint of FIG. 15.

In addition to axially securing the casing portions, the locking mechanism 497 may include a mechanism for a mechanical torque connection. Referring to FIGS. 15, 16, and 16A, the locking mechanism 497 includes an inwardly biasing torque key 498 adapted to engage a groove 499 after a predetermined length of drill casing 405 has been reduced. Alternatively, a spline assembly may be employed to transmit the torsional force between the casing portions.

In another embodiment, another suitable extendable joint is the retractable joint disclosed in U.S. patent application Ser. No. 11/343,148, filed on Jan. 30, 2006 by Jordan et al., entitled "Retractable Joint and Cementing Shoe for Use in Completing a Wellbore," which application is incorporated herein by reference in its entirety. Advantageously, use of the retractable joint during drilling would eliminate the need to form a rat hole.

Referring now to FIG. 12, the drill casing 405 is coupled to the drill pipe 412 which extends to the surface. The drill pipe 412 includes a drilling latch 420 that is adapted to engage a drilling profile 425 of the drill casing 405. The drilling latch 420 is disposed on the drill pipe 412 at a location below the high pressure wellhead 402. The lower portion of the drilling latch 420 includes a drill casing pressure isolation cup 427. Disposed below the drilling latch 420 are an interstring 450; pressure and volume balanced length compensator 465; ball/dart catcher 453; cement by-pass valve 455; instrument package, which includes MWD unit 460, memory and inclination gage 462, and cement by-pass sleeve 467; a sting in float collar 480; and drill shoe 415 with float valve. These components are similar to the ones described in FIG. 3, and thus will not be described further.

A pressure port 485 having an extrudable ball seat is positioned on the interstring 450 and is adapted to control the release of the drill casing 405 from the conductor pipe 410. A ball may be dropped into the extrudable ball seat to close the pressure port 485, thereby increasing the pressure in the drill casing 405 to cause the casing latch 470 to disengage from the casing profile 475. Preferably, the extrudable ball seat is adapted to allow other larger balls and/or dart to pass.

Figure 13:
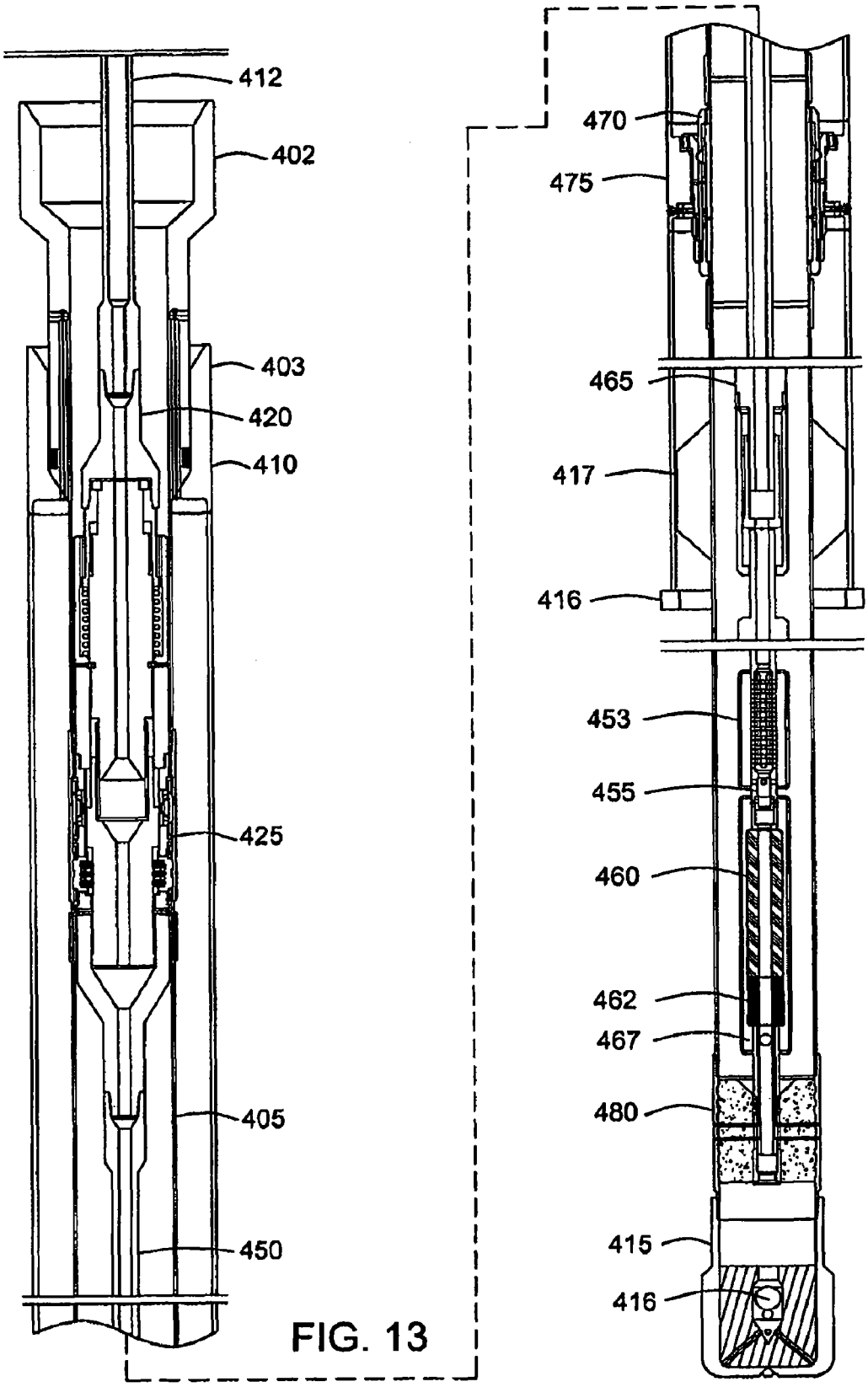
FIG. 13 shows the drilling with casing assembly of FIG. 12 after drilling.

In operation, the nested casing strings 405, 410 are rotated together to drill the conductor pipe 410 and the drill casing 405 into the earth. When the target depth for the conductor pipe 410 is reached, a ball is dropped into the pressure port to pressurize the drill casing 405. The increase in pressure causes the casing latch 470 to disengage from the casing profile 475, as shown in FIG. 13. After release, the drill casing 405 is urged downward by the drill pipe 412 using the drilling latch 420. After reaching target depth for the drill casing 405, the collapsible joint 490 is activated to facilitate the landing of the high pressure wellhead 402 into the low pressure wellhead 403. A force is supplied from the surface to cause the locking mechanism 491 to fail. In this respect, the length of the drill casing 405 is reduced to allow proper seating of the high pressure wellhead 402 in the low pressure wellhead 403. Because the drill casing 405 is not rotated during the landing, damage to the seals in the low pressure wellhead 403 is minimized. In the event an obstruction is encountered before target depth, the high pressure wellhead 402 may still seat in the low pressure wellhead 403 by activating the collapsible joint 490. Cementing and data gathering and transmission may be performed using one of the methods described above.

Method 3

In another embodiment, the conductor pipe and the drill casing are connected together to form a combination string. The conductor pipe and the drill casing are mated at the surface in the same arrangement as their final placement in the hole. In this respect, this embodiment does not require casing latch between the conductor pipe and the drill casing. A drill pipe and a drilling latch may be used to rotate the combination string to drill the hole in which the string will be place. The combination string is cemented in place after the hole is drilled. Preferably, the cement occurs before the drill latch in the drill casing is released. In this case, both the conductor and drill casing will be cemented in place after the hole is drilled and before the drill latch in the drill casing is released.

Figures 14A, 14B, 14C:
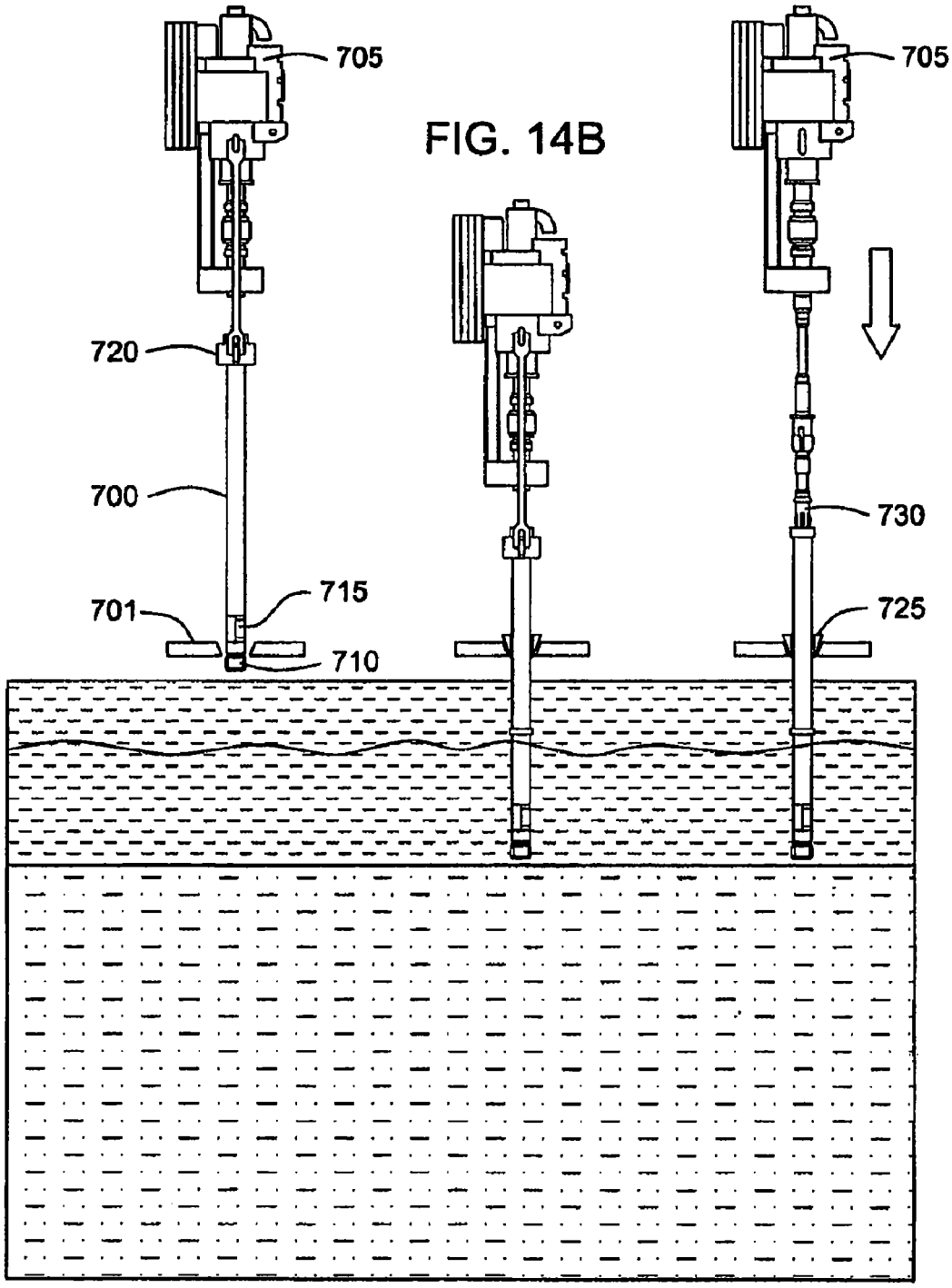
FIGS. 14A-Q are schematic view of a method of drilling with casing in water depths shallower than the casing being run.
Figures 14D, 14E, 14F:
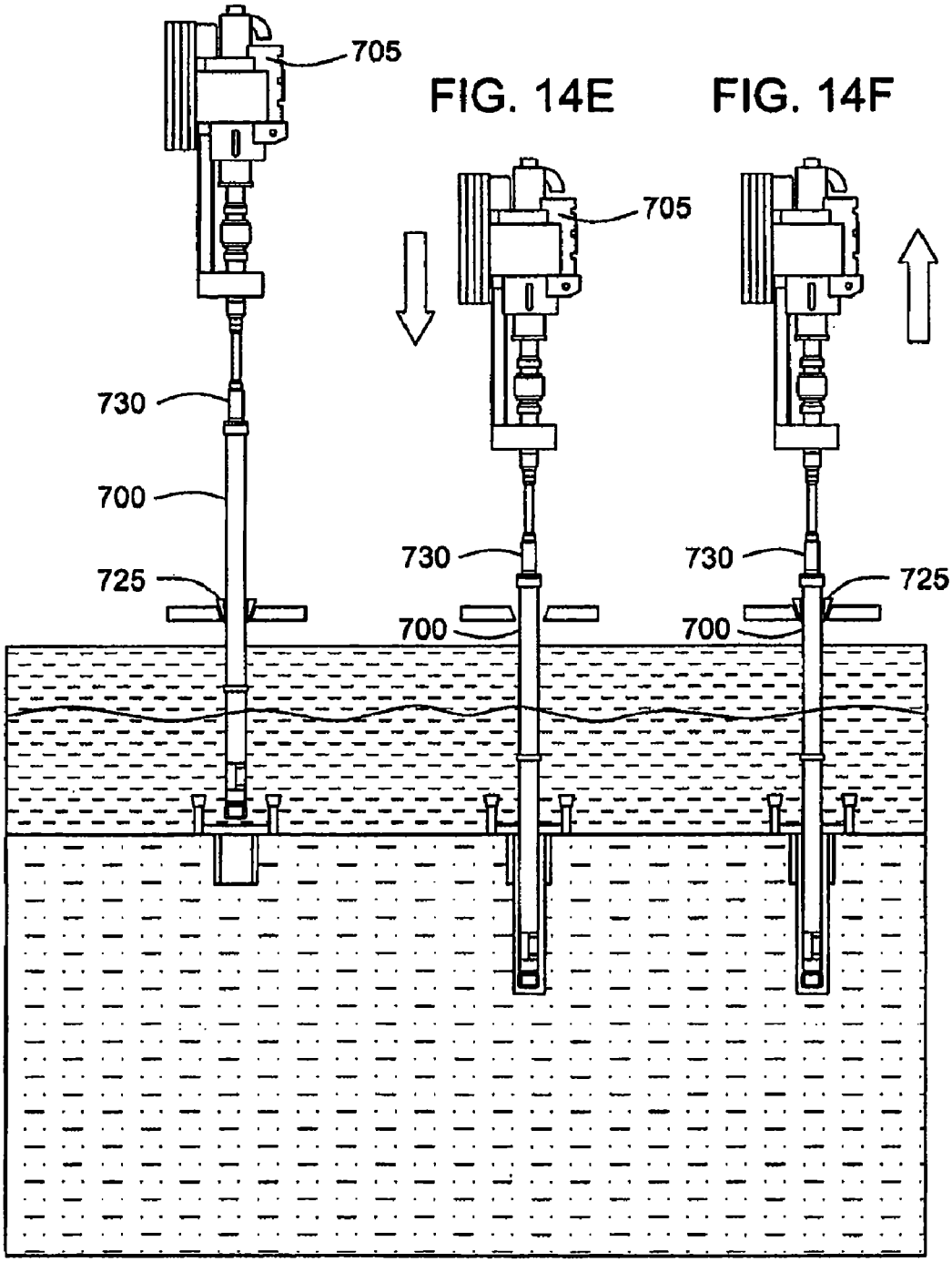
Figures 14G, 14H, 14I:
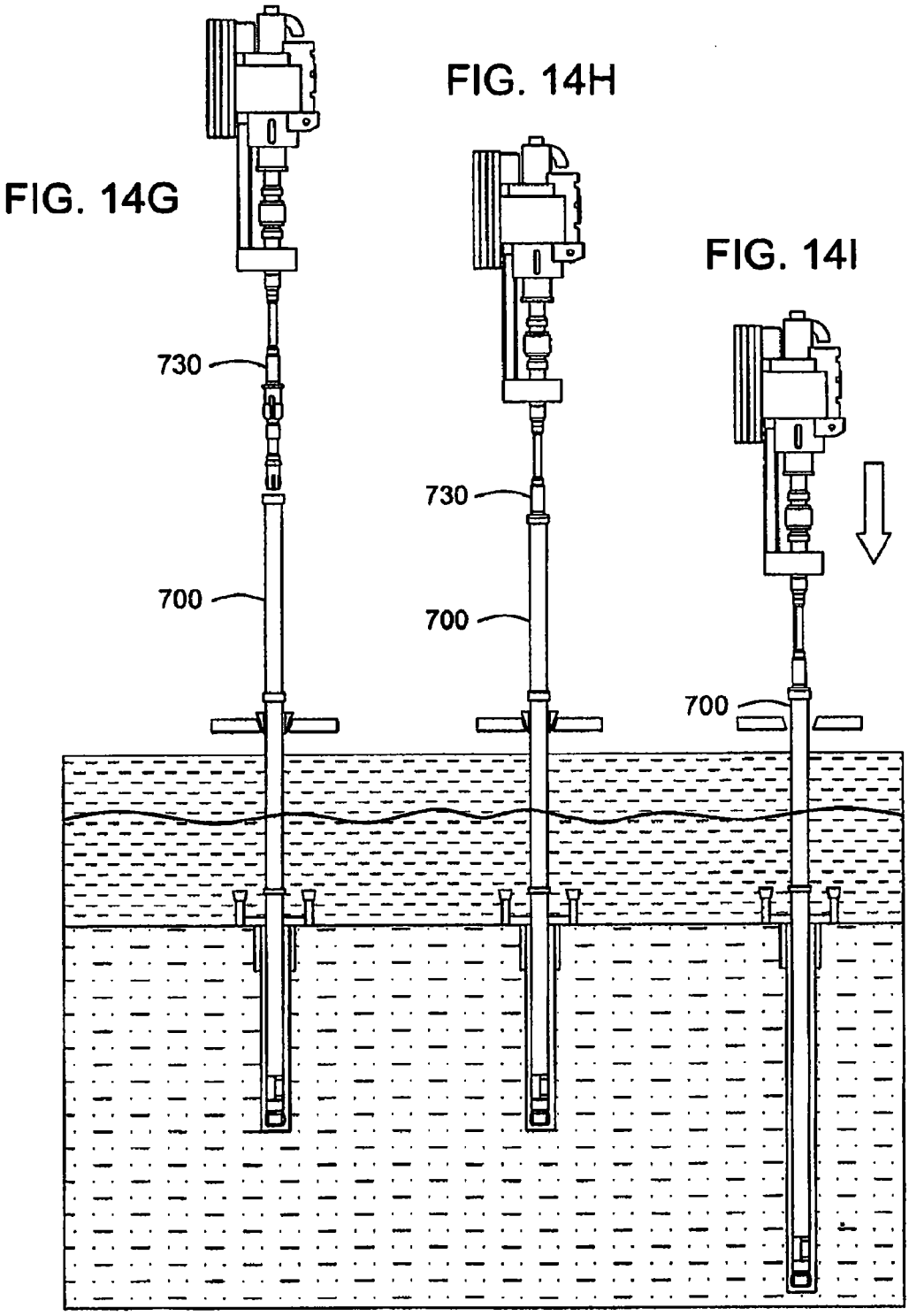
Figures 14J, 14K, 14L:
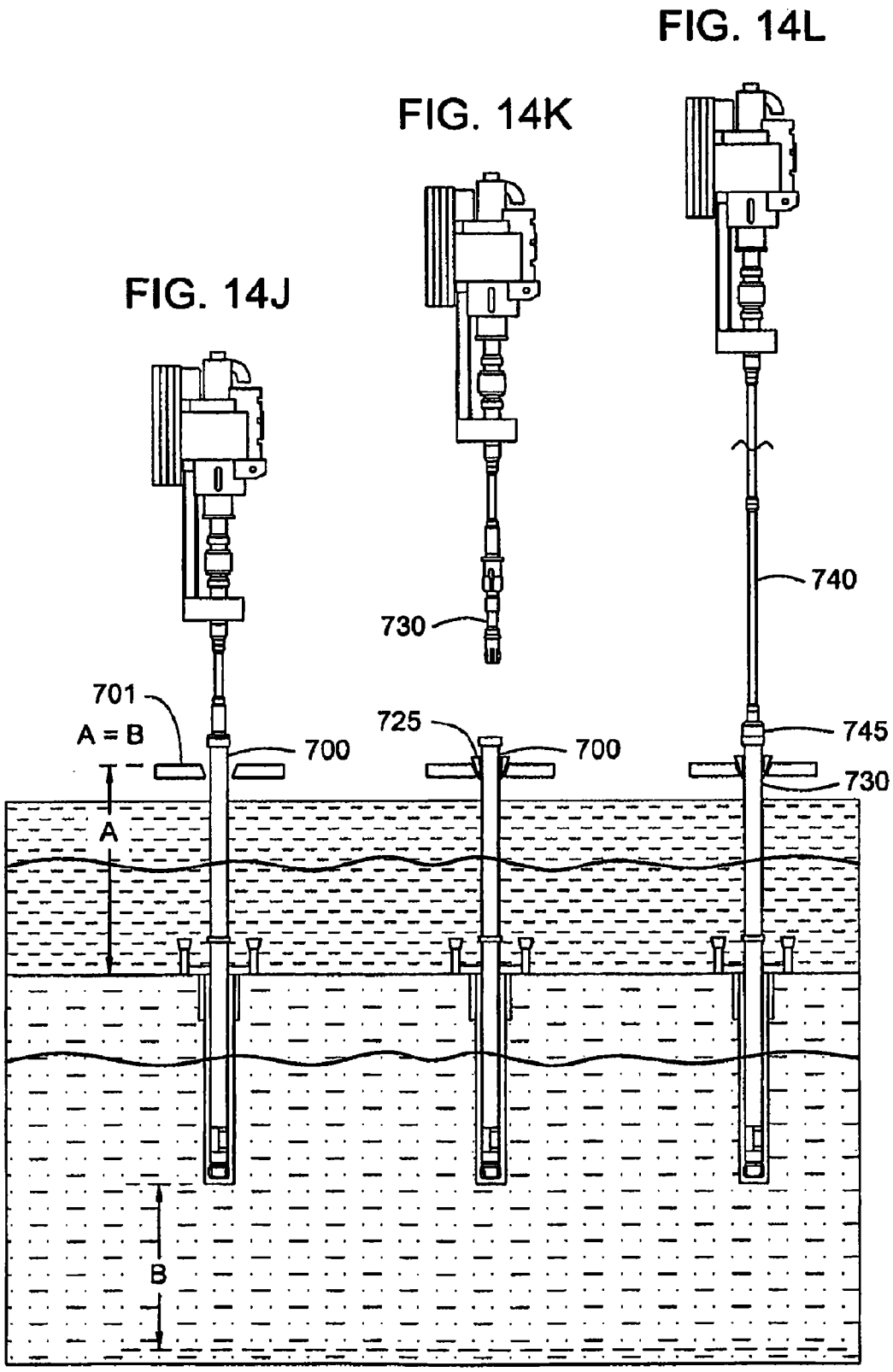
Figures 14M, 14N, 14O:
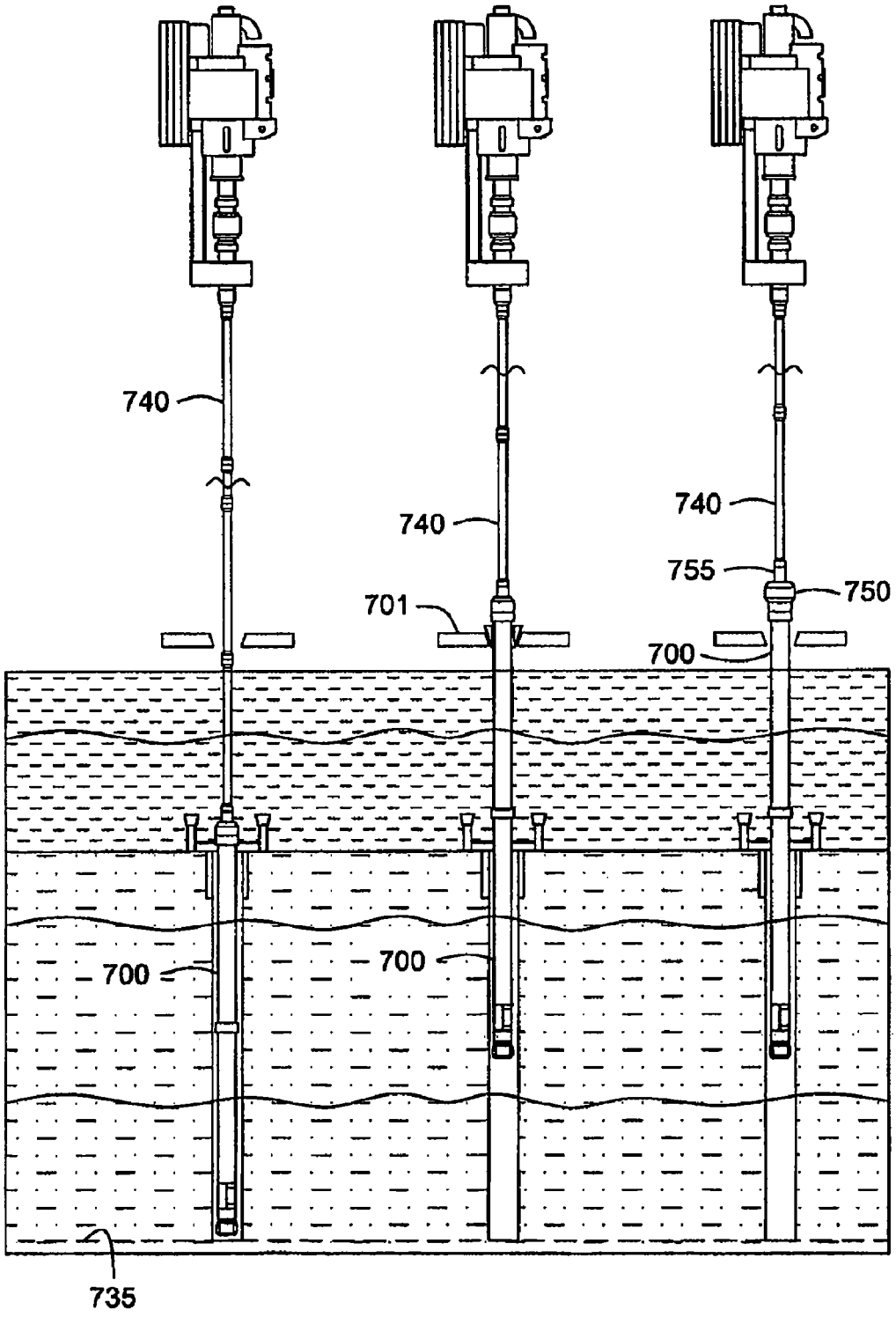

Method of Drilling with Casing in Water Depths Shallower than the Casing Being Run Embodiments of the present invention also provides a method of drilling the casing to depth and setting the casing near the mud line or in previously run casing in situations where the actual water depth is less than the casing length being run. FIGS. 14A-O show a preferred embodiment of drilling with casing to set the casing. It is preferred that drilling with casing from the rig floor 701 is used until the full length of casing has been run. In FIG. 14A, a drill casing 700 having with a drill shoe 710 and float collar 715 is picked up using an elevator 720. A top drive 705 is used to drive and rotate the drill casing 700. In FIG. 14B, additional lengths of drill casing 700 are added until the drill casing 700 is run to the target depth. In FIG. 14C, a spider 725 is used to support the drill casing 700 while an internal casing gripper such as a spear 730 is rigged up to the top drive 705. Alternatively, an external casing gripper such as a torque head may be used. FIG. 14D shows the spear 730 engaging the drill casing 700. Thereafter, the spider 725 is released, and the top drive 705 rotates and drives the spear 730, thereby transmitting the torque and pushing motion to the drill casing 700, as illustrated in FIG. 14E. To add the next casing joint, the spider 725 is used again to support the drill casing 700 so that the spear 730 may disengage from the drill casing 700, as illustrated in FIG. 14F. FIG. 14G shows the next casing added to the drill casing 700. In FIG. 14H, the spear 730 has stabbed-in to the drill casing 700 and ready to continue drilling. FIG. 14I shows the next joint of casing has been drilled. The drilling process continues until the design length of drill casing 700 has been run at the drill floor. In other words, the distance from the target depth 735 to the bottom of the hole is equal to the distance from the mud line to the rig floor 701, as shown in FIG. 14J. If necessary, extra casing length may be added at this point to create a rat hole. Further, the drill casing 700 may optionally be fitted with a collapsible joint. FIG. 14K shows the drill casing 700 supported by the spider 725 and the spear 730 released.

Once the design length of drill casing 700 has been run at the rig floor 701, the drill casing 700 is crossed over to drill pipe 740. In this respect, any of the crossovers as discussed above may be used. In FIG. 14L, a threaded crossover 745 is used to couple the drill pipe 740 to the drill casing 700. If desired, an interstring may be used at this point to add instrumentation and to shorten the time required to pump kill mud to the bottom of the bit.

Figures 14P, 14Q:
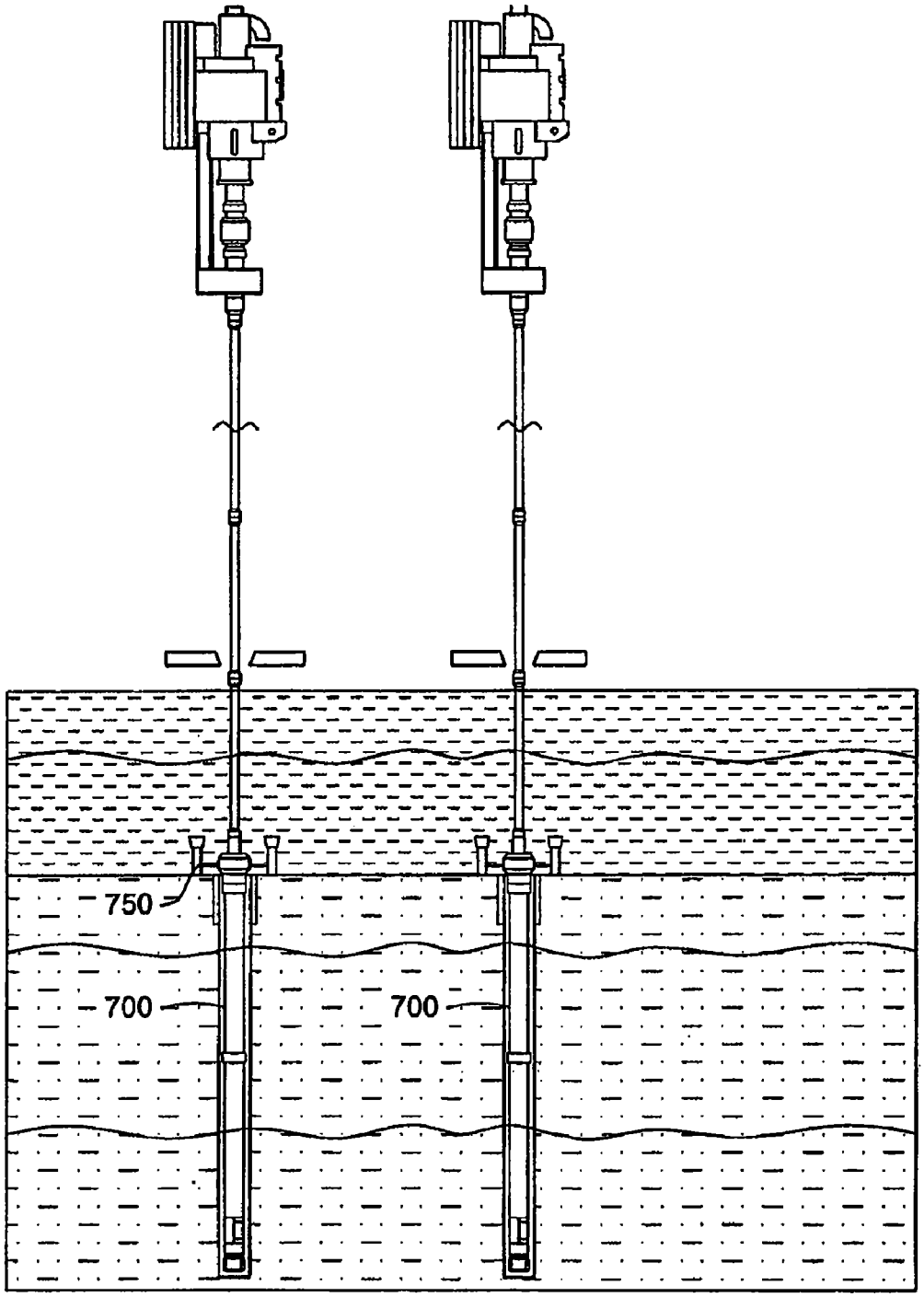

The drill casing 700 is drilled deeper by using drill pipe 740 until the target depth 735 is reached, as illustrated in FIG. 14M. Once the target depth 735 is reached, the drill pipe 740 and the drill casing 700 are pulled back toward the rig floor 701, as illustrated in FIG. 14N. The drill pipe 740 to crossover 745 is recovered, and any extra length of casing used to create a rat hole is removed from the drill casing 700. If present, the interstring is removed before the casing is run back in the hole for cementing. In FIG. 14O, a casing hanger or liner hanger 750 is then installed on top of the drill casing 700. A running tool 755 used with the casing hanger or liner hanger 750 is then used to crossover the drill casing 700 to the drill pipe 740. Preferably, the running tool 755 used will allow some rotation of the drill casing 700 in case the drill casing 700 needs to be reamed to bottom. A liner cementing plug(s) or an SSR plug system is run below the running tool 755 for cementing. The drill casing 700 is then lowered back into the hole until the casing hanger or liner hanger depth is reached or lands in the wellhead, as shown in FIG. 14P. In FIG. 14Q, the drill casing 700 is cemented using the SSR type or liner type plug(s).

Although this method is described for use in a situation where the casing length is longer than the water depth, it is contemplated that the method may also be used where the casing length is shorter than the water depth. In operation, after the casing has been pulled clear of the hole, the casing may be directed back into the hole using a remote operated vehicle ("ROV"), sensors such as sonic or a remote camera located on or in the drill casing near or on or in the drill shoe, or by trial and error in stabbing the casing. Additionally, this method may be used with a nudging bit or a bent casing joint if the drill casing is to be drilled directionally.

Various modifications or enhancements of the methods and apparatus disclosed herein are contemplated. To that end, the drilling methods and systems described in this disclosure are usable with multiple drilling practices using a mobile offshore drilling unit ("MODU"). The drilling methods may be used in a batch setting system where a number of wells are to be drilled from a single template. Further, the drilling systems allow the drilling of the conductor, structural, and/or surface casing on all or selected slots of the template prior to the installation of the permanent drilling structure such as a tension leg platform. Also, because the drilling will be carried out riserless, moving a BOP and riser pipe between holes is not required to set the conductor-structural-surface pipe. Further, use of batch drilling and pre-setting the conductor pipe prior to the installation of the permanent drill structure may reduce the specified weight capacity of the structure and the drilling equipment used to complete the wells.

The drilling methods for the drill casing disclosed herein are also usable with subsequent drilling systems used on MODU, such as mud line BOP with low pressure riser pipe to the surface or mud line shut-off disconnect, such as Cameron's ESG or Geoprober Shut-off System as disclosed in U.S. Pat. No. 6,367,554 and surface BOP.

The drilling methods disclosed herein are applicable to dual gradient drilling systems. An exemplary dual gradient drilling system is disclosed in U.S. Patent Application filed on Feb. 28, 2006 by Hannegan, et al., entitled "Dual Gradient Riserless Drilling System," which application is incorporated herein by reference in its entirety.

The drilling methods disclosed herein are usable on fixed and jack up drilling platforms.

The drilling methods disclosed herein are applicable to a satellite well as well as an exploratory well. The drilling methods may be used on either offshore or onshore wells.

The drilling methods disclosed herein may be used to drill deeper than the surface casing, such as drilling in a liner and/or drilling in a long string.

The drilling methods disclosed herein may be used with expandable casing. Using an interstring will allow the pipe to be expanded with a cone and/or roller expander system while the interstring is retrieved from the casing.

The drilling methods disclosed herein may be used with an apparatus for controlling a subsea borehole fluid pressure to position a conductor casing below the mudline. Such an apparatus is disclosed in U.S. Pat. No. 6,138,774, issued to Bourgoyne, Jr. et al., which patent is incorporated by reference herein in its entirety. In one embodiment, the apparatus includes a pump for moving a fluid through a tubular into a borehole. The fluid, before being pumped, exerts a pressure less than the pore pressure of an abnormal pore pressure environment. The fluid in the borehole is then pressurized by the pump to at least a borehole pressure equal to or greater than the pore pressure of an abnormal pore pressure environment. A pressure housing assembly allows for the drilling of a borehole below the conductor casing into an abnormal pore pressure environment while maintaining the pressurized fluid between a borehole pressure equal to or greater than the pore pressure of the abnormal pore pressure environment, and below the fracture pressure of the borehole in the abnormal pore pressure environment.

Methods and apparatus are provided to place a conductor pipe and a casing in a subsea environment. In one embodiment, a conductor pipe is jetted or drilled into the subsea floor. Thereafter, a casing drilling assembly comprising a drill casing and a drilling assembly is connected to the drill pipe using a crossover. The drilling assembly urged into the seafloor until a casing latch on the drilling assembly is engaged with a casing profile of the conductor pipe. During drilling, instrumentation in the drilling assembly may be used to measure geophysical data. The measured data may be used to optimize the drilling process. After the drill casing is engaged with the conductor pipe, cementing may be performed to set the drill casing.

In another embodiment, the conductor pipe and the casing may be placed into the earth as a nested casing strings assembly. A casing latch is used to couple the casing to the conductor pipe. In this respect, the conductor pipe rotated with casing during drilling. After conductor pipe is placed at target depth, the casing is released from the conductor pipe and is drilled further into the earth. In one embodiment, the casing is drilled until a wellhead on the casing is engaged with a wellhead of the conductor pipe. In another embodiment, a collapsible joint is provided on the casing to facilitate the engagement of the casing wellhead with the wellhead of the conductor pipe.

In yet another embodiment, the conductor pipe and the drill casing are connected together to form a combination string. The conductor pipe and the drill casing are mated at the surface in the same arrangement as their final placement in the hole. In this respect, this embodiment does not require casing latch between the conductor pipe and the drill casing. A drill pipe and a drilling latch may be used to rotate the combination string to drill the hole in which the string will be place. The combination string is cemented in place after the hole is drilled. Preferably, the cement occurs before the drill latch in the drill casing is released. Placed in the hole, to drill the hole insert the combination string In this case both the conductor and drill casing will be cemented in place after the hole is drilled and before the drill latch in the drill casing is released.

In yet another embodiment, a method of lining a wellbore comprises positioning a first casing in the wellbore, providing a drilling assembly; lowering the drilling assembly into the first casing; and coupling the second casing to the first casing. Preferably, the drilling assembly includes a second casing; a conveying member; a tubular adapter for coupling the conveying member to the second casing, wherein the tubular adapter is adapted to transfer torque from the conveying member to the second casing; and a drilling member disposed at a lower end of the second casing.

In yet another embodiment, a method for lining a portion of a wellbore comprises rotating a casing assembly into the wellbore while forming the wellbore, the casing assembly comprising an outer casing portion and an inner casing portion wherein the outer and inner casing portions are operatively connected; disabling a connection between the inner casing portion and the outer casing portion; and lowering the inner casing portion relative to the first casing portion.

In yet another embodiment, an apparatus for lining a wellbore comprises a casing; a drilling member disposed at a lower end of the casing; a conveying member; and a tubular adapter for coupling the conveying member to the casing.

In yet another embodiment, a method of lining a wellbore comprises positioning a first casing in the wellbore; providing a drilling assembly having a second casing and a drilling member; forming a wellbore using the drilling assembly; connecting a conveying member having a diameter less than the second casing to the second casing, wherein a tubular adapter is used to couple the conveying member to the second casing; providing a casing hanger on the second casing; and coupling the second casing to the first casing.

In one or more embodiments described herein, the conveying member comprises drill pipe.

In one or more embodiments described herein, the tubular adapter comprises a crossover.

In one or more embodiments described herein, the tubular adapter comprises a tubular running tool.

In one or more embodiments described herein, the tubular adapter comprises a latch disposed on the conveying member, the latch engageable with a profile formed on the second casing.

In one or more embodiments described herein, the tubular adapter comprises an internal tubular gripping member.

In one or more embodiments described herein, the tubular adapter comprises threaded crossover.

In one or more embodiments described herein, the conveying member is released from the second casing.

In one or more embodiments described herein, the conveying member is retrieved.

In one or more embodiments described herein, the second casing is cemented.

In one or more embodiments described herein, a collapsible joint to reduce a length of the second casing is used.

In one or more embodiments described herein, the first casing includes a first wellhead and the second casing includes a second wellhead, wherein the second wellhead is adapted to seat in the first wellhead.

In one or more embodiments described herein, the conveying member is coupled to a top drive.

In one or more embodiments described herein, the drilling member comprises a drill shoe.

In one or more embodiments described herein, the drilling member comprises a drill bit and an underreamer.

In one or more embodiments described herein, an interstring coupled to the tubular adapter and the drilling member is provided.

In one or more embodiments described herein, a length compensator is used to change a length of the interstring.

In one or more embodiments described herein, plug/ball receiving member is provided.

In one or more embodiments described herein, cement bypass valve is provided.

In one or more embodiments described herein, a MWD unit is provided.

In one or more embodiments described herein, a memory gage and an inclination gage are provided.

In one or more embodiments described herein, an instrument float collar is provided.

In one or more embodiments described herein, the instrument float collar comprises one or more sensors for measuring geophysical parameters.

In one or more embodiments described herein, one or more cementing plugs are provided.

In one or more embodiments described herein, an apparatus for controlling a subsea borehole fluid pressure to position a conductor casing below the midline is provided.

In one or more embodiments described herein, a drilling fluid is changed in response to the measured one or more geophysical parameters.

In one or more embodiments described herein, the tubular adapter comprises a spiral joint.

In one or more embodiments described herein, the tubular adapter comprises a spiral joint.

In one or more embodiments described herein, a motor for rotating the drilling member is provided.

While the foregoing is directed to embodiments of the present invention, other and further embodiments of the invention may be devised without departing from the basic scope thereof, and the scope thereof is determined by the claims that follow.

We claim:

1. A method for lining a wellbore comprises:
drilling a casing to a first depth;
coupling the casing to a drill pipe;
drilling the casing to a second depth, wherein a distance from the first depth to the second depth is equal to a distance from a mud line to a rig floor;
coupling a retaining assembly to the casing; and
lowering and coupling the retaining assembly to a wellhead.

2. The method of claim 1, wherein the retaining assembly comprises a liner hanger or a casing hanger.

3. The method of claim 1, wherein a top drive used to drill the casing.

4. The method of claim 3, wherein the top drive grips the casing.

5. The method of claim 4, wherein the top drive grips the drill pipe while drilling to the second depth.

6. The method of claim 1, further comprising retrieving the drill pipe and the casing to surface before coupling the retainer assembly to the casing.

7. A method for lining a wellbore comprises:
using a top drive to grip a casing;
operating the top drive to rotate the casing to drill to a first depth;
coupling the casing to a drill pipe;
drilling the casing to a second depth;
coupling a retaining assembly to the casing; and
lowering and coupling the retaining assembly to a wellhead.

8. The method of claim 7, wherein the top drive grips the drill pipe while drilling to the second depth.

9. The method of claim 7, further comprising retrieving the drill pipe and the casing to surface before coupling the retainer assembly to the casing.

10. A method for lining a wellbore comprises:
drilling a casing to a first depth;
coupling the casing to a drill pipe;
drilling the casing to a second depth;
retrieving the drill pipe and the casing to surface, and then coupling a retaining assembly to the casing; and
lowering and coupling the retaining assembly to a wellhead.

* * * * *